US010947991B2

(12) United States Patent
Faruquee et al.

(10) Patent No.: US 10,947,991 B2
(45) Date of Patent: Mar. 16, 2021

(54) FAN SHROUD

(71) Applicant: Deere & Company, Moline, IL (US)

(72) Inventors: Zakir Faruquee, Asbury, IA (US); Erik Holzhuter, Dubuque, IA (US); Mike P. Faust, Garber, IA (US); Luke Longhenry, Cuba City, WI (US); Joel Khristy, Naperville, IL (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 16/354,673

(22) Filed: Mar. 15, 2019

(65) Prior Publication Data

US 2020/0291960 A1 Sep. 17, 2020

(51) Int. Cl.

| | |
|---|---|
| ***F04D 29/54*** | (2006.01) |
| ***F01P 5/06*** | (2006.01) |
| ***F01P 11/10*** | (2006.01) |

(52) U.S. Cl.

CPC ..... *F04D 29/545* (2013.01); *F01P 5/06* (2013.01); *F01P 11/10* (2013.01)

(58) Field of Classification Search

CPC .... F04D 29/552; F04D 29/545; F04D 29/547; F04D 29/663; F04D 29/665; F04D 29/667; F01P 5/05; F01P 11/10

See application file for complete search history.

(56) References Cited

U.S. PATENT DOCUMENTS

| | | | | |
|---|---|---|---|---|
| 3,794,001 | A * | 2/1974 | Birch | F04D 29/164 123/41.05 |
| 3,858,644 | A * | 1/1975 | Beck | F01P 5/06 165/51 |
| 5,489,186 | A * | 2/1996 | Yapp | F01D 5/141 415/208.3 |
| 6,676,371 | B1 * | 1/2004 | Brown | F04D 29/023 123/41.49 |
| 9,157,455 | B2 * | 10/2015 | Bilodeau | F04D 29/663 |
| 10,041,505 | B2 * | 8/2018 | Stevens | F04D 29/526 |

(Continued)

FOREIGN PATENT DOCUMENTS

| | | |
|---|---|---|
| CN | 204880603 U | 12/2015 |
| DE | 102015224344 A1 | 6/2017 |

(Continued)

OTHER PUBLICATIONS

John Deere, "Shroud Part No. T294150 for 332E Skid Steer Loader," <https://partscatalog.deere.com/jdrc/sidebyside/equipment/63109/referrer/search/pgId/6850056>, web page publicly available at least as early as Feb. 18, 2019.

(Continued)

*Primary Examiner* — Nathaniel E Wiehe
*Assistant Examiner* — Ryan C Clark
(74) *Attorney, Agent, or Firm* — Michael Best & Friedrich LLP

(57) ABSTRACT

A shroud for a cooling fan that is being positionable within the chassis of an off-highway machine. The shroud includes an inlet, an outlet, an elliptical lip section positioned adjacent to the outlet, and a plurality of apertures extending through the elliptical lip section. Each aperture of the plurality of apertures is positioned greater than 10 degrees away from an adjacent aperture of the plurality of apertures.

11 Claims, 20 Drawing Sheets

(56) References Cited

U.S. PATENT DOCUMENTS

| | | | | |
|---|---|---|---|---|
| 10,072,670 | B2 * | 9/2018 | Jung | F04D 29/526 |
| 2008/0219836 | A1 | 9/2008 | Decker et al. | |
| 2017/0350412 | A1 * | 12/2017 | Hioki | F04D 29/164 |

FOREIGN PATENT DOCUMENTS

| | | | |
|---|---|---|---|
| EP | 3073121 | A1 | 9/2016 |
| WO | WO2018072664 | A1 | 4/2018 |

OTHER PUBLICATIONS

John Deere, "Shroud Part No. AT447978 for 437E Knuckleboom Log Loader," <https://partscatalog.deere.com/drc/sidebyside/equipment/81754/referrer/search/pgId/237522305>, web page publicly available at least as early as Feb. 18, 2019.

John Deere, "Shroud Part No. T397959 for E140LC Excavator," <https://partscatalog.deere.com/jdrc/sidebyside/equipment/1345789/referrer/search/pgId/217542605/partnumber/T397959/callout/22>, web page publicly available at least as early as Feb. 18, 2019.

John Deere, "Shroud Part No. T352549 for WL56 Loader," <https://partscatalog.deere.com/jdrc/sidebyside/equipment/68898/referrer/search/pgId/154027016>, web page publicly available at least as early as Feb. 18, 2019.

John Deere, "Shroud Part No. AT425301 for 710L Backhoe Loader," <https://partscatalog.deere.com/jdrc/sidebyside/equipment/171246/referrer/search/pgId/265599467/partnumber/AT425301/callout/1>, web page publicly available at least as early as Feb. 18, 2019.

John Deere, "Shroud Part No. T368719 for E260LC Excavator," <https://partscatalog.deere.com/jdrc/sidebyside/equipment/613564/referrer/search/pgId/212925555>, web page publicly available at least as early as Feb. 18, 2019.

John Deere, "Shroud Part No. AT455495 for 853M Tracked Feller Buncher," <https://partscatalog.deere.com/drc/sidebyside/equipment/65533/referrer/search/pgId/285028132/partnumber/AT455495/callout/1>, web page publicly available at least as early as Feb. 18, 2019.

European Search Report issued in counterpart application No. 20163174.4 dated Jul. 17, 2020 (08 pages).

* cited by examiner

FAN SHROUD

BACKGROUND

The present disclosure relates to off-highway machines and specifically to a fan shroud for use with off-highway machines.

SUMMARY

One embodiment includes a shroud for a cooling fan that is positionable within the chassis of an off-highway machine. The shroud includes an inlet having a first external side, a second side, a third side, and a fourth side, and an outlet. An elliptical lip section is positioned at the outlet, and includes a first planar face and a second planar face facing away from the first planar face. The second planar face has a centroid. The shroud further includes a plane that is coincident with the second planar face. The plane includes a first axis parallel to the second and fourth sides of the inlet, and a second axis perpendicular to the first axis. Both the first axis and the second axis pass through the centroid. The first and second axes together divide the elliptical lip section into four quadrants, and a plurality of apertures extend through the elliptical lip section. At least one aperture of the plurality of apertures is positioned in each quadrant of the four quadrants of the elliptical lip section.

Another embodiment includes a shroud for a cooling fan that is being positionable within the chassis of an off-highway machine. The shroud includes an inlet, an outlet, an elliptical lip section positioned adjacent to the outlet, and a plurality of apertures extending through the elliptical lip section. Each aperture of the plurality of apertures is positioned greater than 10 degrees away from an adjacent aperture of the plurality of apertures.

Another embodiment includes a shroud for a cooling fan that is positionable within the chassis of an off-highway machine. The shroud includes an inlet, an outlet, and an elliptical lip section positioned adjacent to and extending radially outwardly from the outlet. The elliptical lip section defines a plane and includes a first planar face and a second planar face facing away from the first planar face. The second planar face has a centroid. The shroud further includes a plane that is coincident with the second planar face. The plane includes a first axis parallel to the second and fourth sides of the inlet and a second axis perpendicular to the first axis. Both the first axis and the second axis pass through the centroid. A plurality of apertures extend through the elliptical lip section and are configured to at least partially relieve a pressure gradient generated by a portion of the elliptical lip section.

DETAILED DESCRIPTION

Before implementations of the disclosure are explained in detail, it is to be understood that the disclosure is not limited in its application to the details of construction and the arrangement of components set forth in the following description or illustrated in the accompanying drawings. The disclosure is capable of supporting other implementations and of being practiced or of being carried out in various ways. Moreover, the term 'substantially' is understood by those of ordinary skill to refer to reasonable ranges outside of the given value, for example, general tolerances or resolutions associated with manufacturing, assembly, and use of the described embodiments and components herein. Further, the term 'approximately' as used herein means plus or minus 5 degrees.

Figure 1:
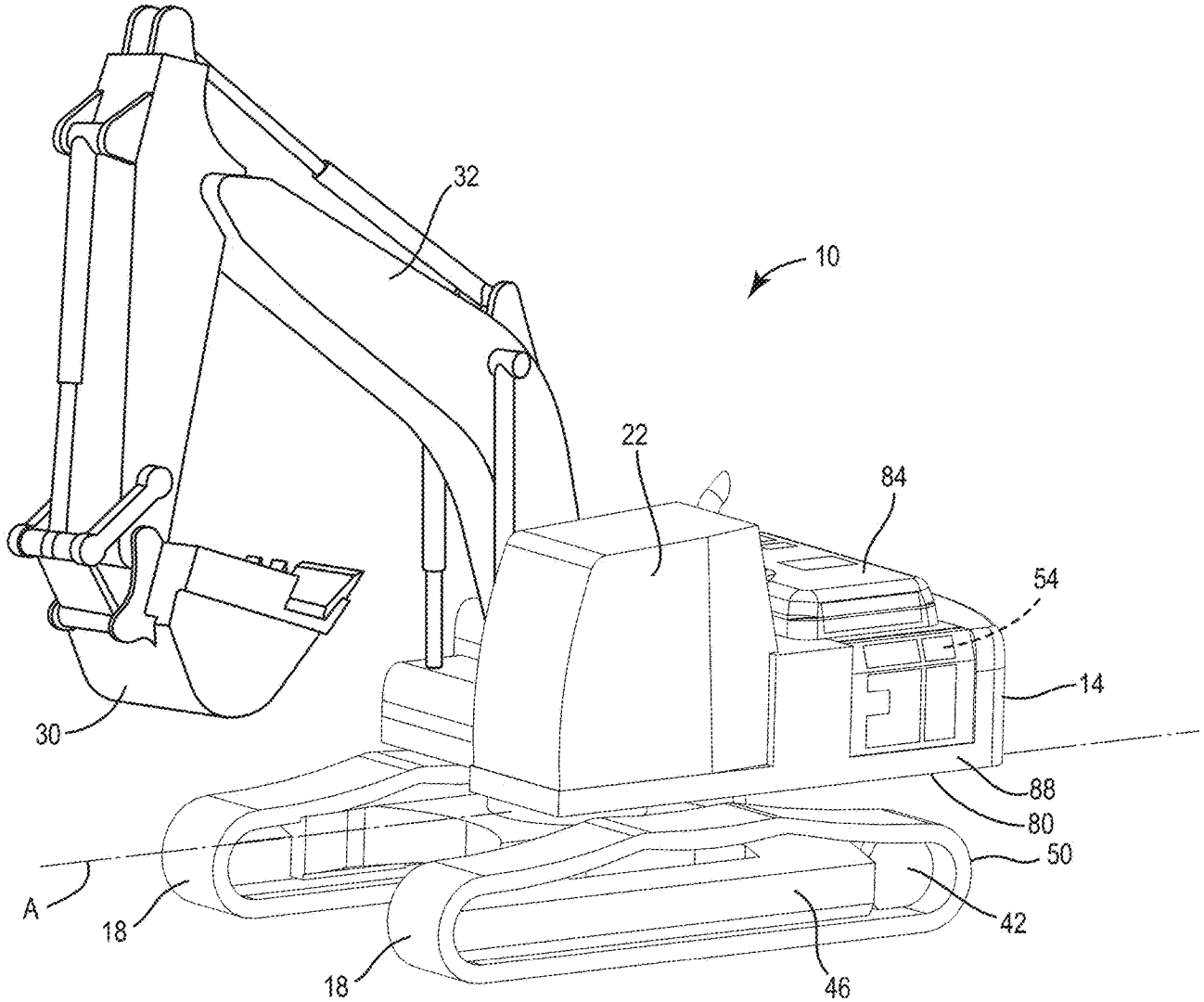
FIG. 1 is a perspective view of an off-highway machine.

FIG. 1 illustrates an off-highway machine, such as an excavator 10, having a chassis 14 and traction members (e.g., crawler mechanisms or tracks 18) for supporting and propelling the chassis 14 and therefore the machine 10 along a surface. The traction members 18 are oriented parallel to a longitudinal axis A of the chassis 14, which coincides with a forward direction of travel of the machine 10 during operation. In the illustrated embodiment, each crawler mechanism 18 includes a drive sprocket 42, an undercarriage frame 46, and a track 50. The drive sprocket 42 is driven by a prime mover 54 and engages the track 50. The track 50 is driven in an endless loop around the drive sprocket 42 and the undercarriage frame 46. The machine 10 further includes an operator cab 22 and a tool or work attachment (e.g., a bucket 30) supported on an end of an arm 32.

Although the off-highway machine 10 is illustrated and described as an excavator, it is understood that the off-highway machine 10 may have a different form, such as a loader, a dozer, a motor grader, a scraper, or another type of construction, mining, agricultural, or utility machine. Also, although the work attachment is illustrated and described as a bucket, it is understood that the work attachment may have a different form, such as an auger, a breaker, a ripper, a grapple, or some other type of attachment for digging, breaking, handling, carrying, dumping or otherwise engaging dirt or other material. In addition, the work attachment may be detachable from the arm 32 to permit another type of work attachment to be coupled to the arm 32.

Figure 2:
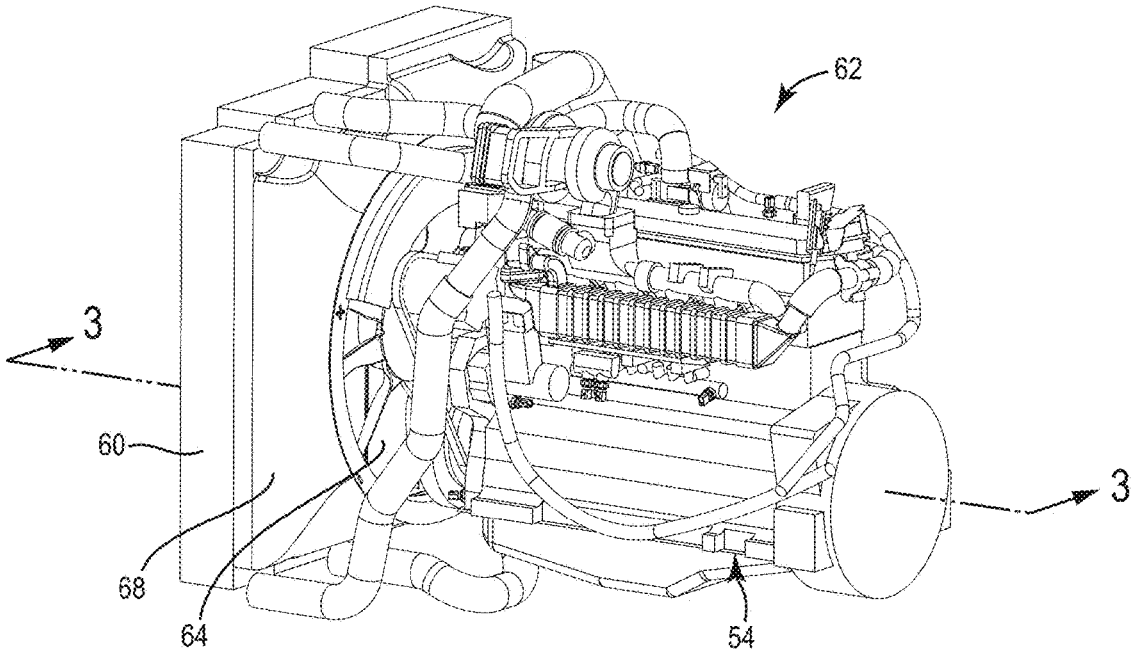
FIG. 2 is a perspective view of an engine with a cooling package, a fan, and a shroud within a chassis of the off-highway machine of FIG. 1.
Figure 3:
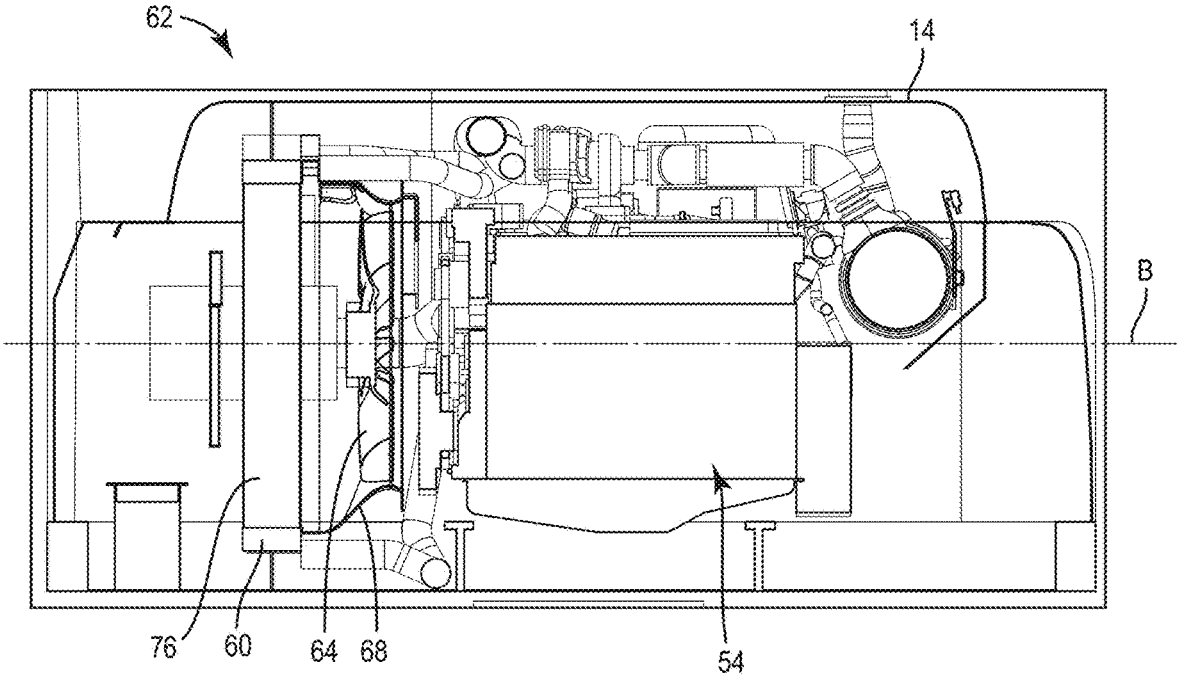
FIG. 3 is a cross-sectional view through the portion of the chassis of FIG. 2 taken along 3-3.

As shown in FIGS. 2-3, the chassis 14 houses an engine 62. The engine 62 includes the prime mover 54, a cooling package 60, a fan 64, and a shroud 68, which are aligned along an axis B transverse to the longitudinal axis A (FIG. 1). The cooling package 60 includes one or more heat exchangers or coolers 76. Other underhood components (i.e., filters, pumps, conduits, reservoirs, sensors, batteries, valves, etc.) may also make up part of the overall engine 62.

Figure 4:
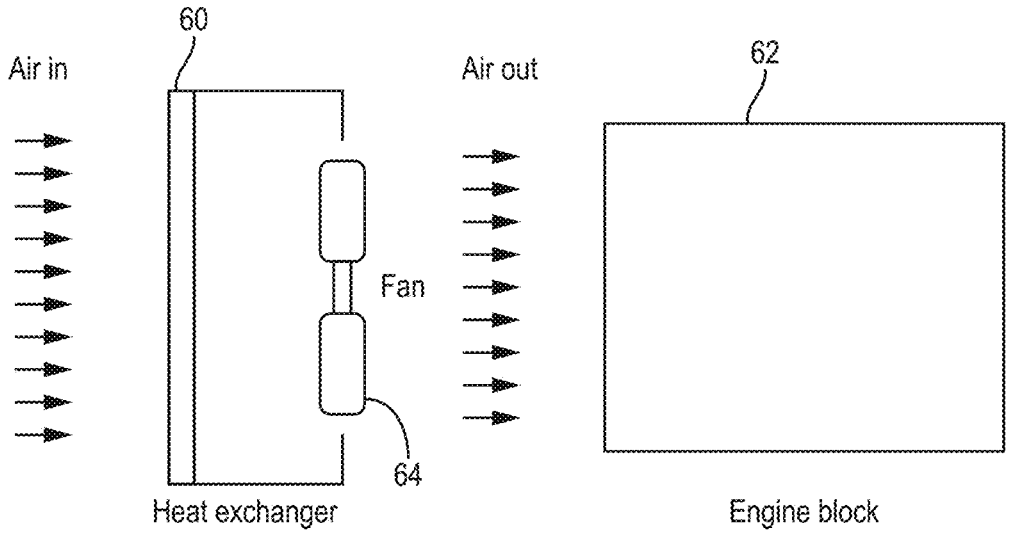
FIG. 4 is a schematic of airflow in one orientation through the cooling package, the fan, and the shroud of FIG. 2.
Figure 5:
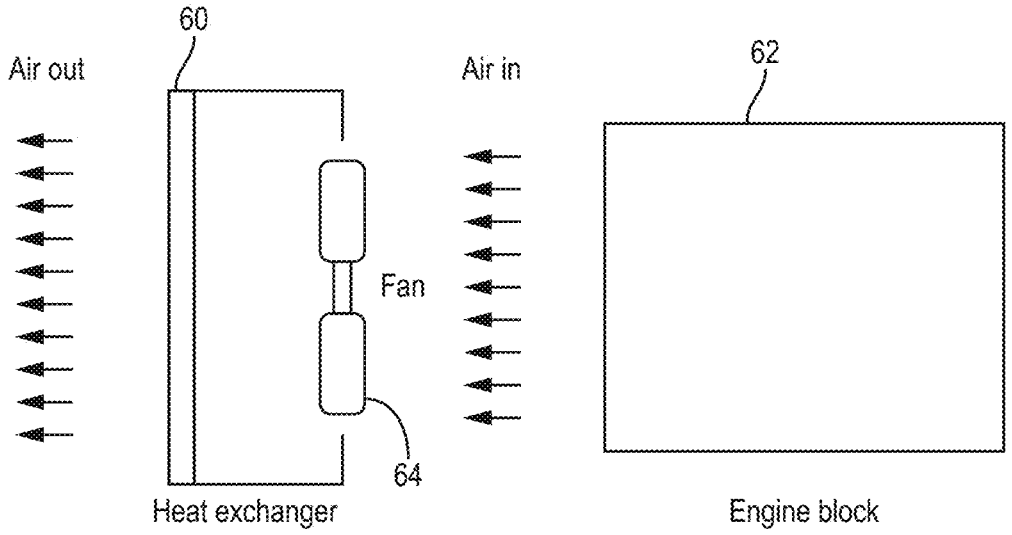
FIG. 5 is a schematic of airflow in another orientation through the cooling package, the fan, and the shroud of FIG. 2.

The schematics in FIGS. 4-5 illustrate that the fan 64 can operate in either a suction mode or a blower mode. In the suction mode, shown in FIG. 4, airflow enters the cooling package 60 through the chassis 14 and then flows to the fan 64 and over portions of the engine 62. In the blower mode, shown in FIG. 5, airflow enters the fan 64 after passing over portions of the engine 62, passes over and through the cooling package 60, and exits via the chassis 14.

In either flow configuration, the performance of the fan 64 is affected by virtue of its position between the cooling package 60 and the engine 62. Specifically, the fan 64 is subjected to upstream and downstream loading. For example and with renewed reference to FIG. 3 (for example), when the fan 64 is mounted adjacent the engine 62 the air flow coming from the cooling package 60 and passing through the fan 64 is immediately subjected to blockage created by the engine block and other underhood components.

Figure 6:
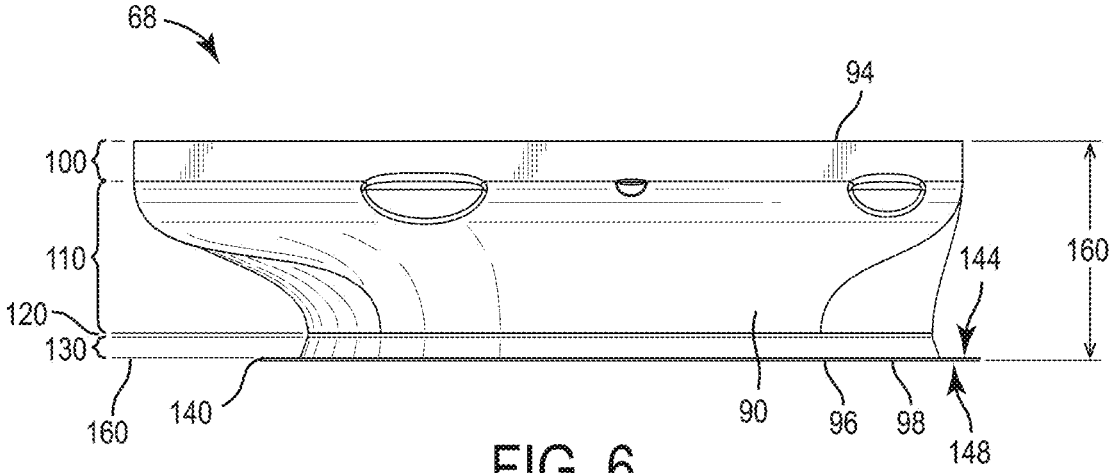
FIG. 6 is a side view of the shroud illustrated in FIG. 2.
Figure 7:
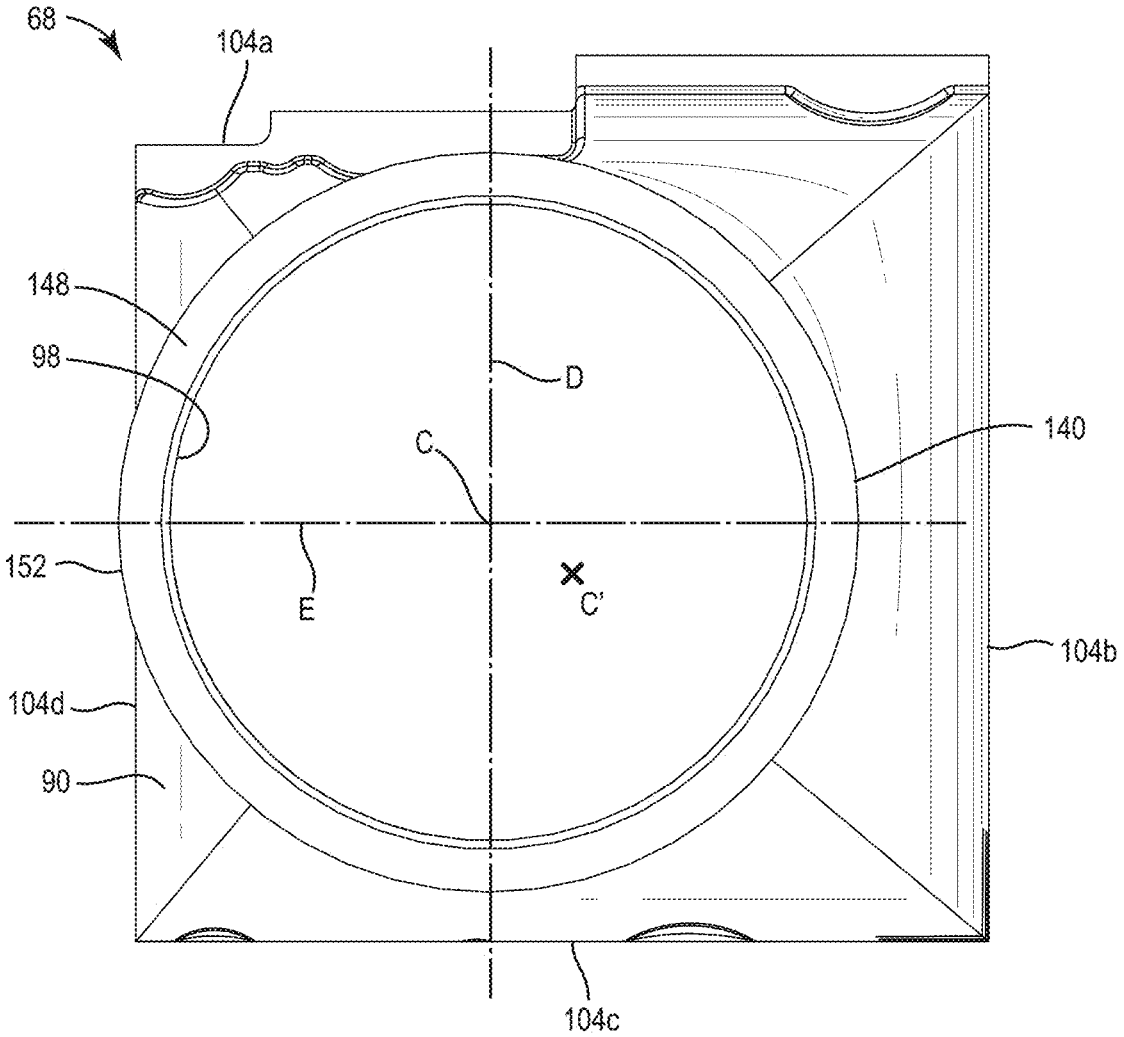
FIG. 7 is a rear view of a face of the shroud of FIG. 6.

FIGS. 6-7 illustrate a conventional shroud 68. The shroud 68 includes a body 90 having an inlet 94 and an outlet 98 opposite the inlet 94. The body 90 defines a breathing section 100, a convergence section 110, a plateau section 120, a divergence section 130, and a lip section 140. With respect to the orientation of FIG. 4, the breathing section 100 collects air exiting the cooling package 60 and provides a steady region of weak pressure gradient to ease flow transition between the surfaces of the cooling package 60 and the convergence section 110. The breathing section 110 is substantially rectangular and has a first side 104*a*, a second side 104*b*, a third side 104*c*, and a fourth side 104*d*. The length of the breathing section 100 (in the direction of axis B) may range from approximately 25 mm to approximately 100 mm depending on the overall shroud length, which is based on the engine type. The convergence section 110 guides accelerating air from the larger rectangular form of the breathing section 100 into a smaller circular cross-section within which the fan 64 is located. The convergence section 110 reduces flow separation and vortices by governing the acceleration of air to be slow enough to avoid turbulent transition of boundary layer air. The length of the convergence section 110 may range from approximately 150 mm to approximately 400 mm. The plateau section 120 transitions the shroud 68 between the convergence section 110 and the divergence section 130, which contains and decelerates the airflow immediately after the fan 64 prior to release over the engine block of the engine 62. The length of the plateau section 120 may range from approximately 5 mm to approximately 20 mm. The lip section 140 extends radially at the outlet 98 and presents opposing first and second faces 144, 148 with a common perimeter or outer profile or boundary 152. The lip section 140 may be used to mount a finger guard. In the embodiment illustrated in FIGS. 6-7, the lip section 140 is circular, and has a radial distance of between 35 mm inches and 80 mm. The lip section 140 may have other suitable shapes and radial distances. For example, the lip section 140 may be elliptical with non-zero eccentricity or have any other suitable arcuate or curvilinear shape.

Further with respect to FIG. 6, the outlet 98, which can also be represented by the lip section 140, is offset with respect to the inlet (i.e., the breathing section 100). That is, the shroud 68 defines a centroid or geometric center C of the lip section 140 that is offset from a centroid or geometric center C' of the breathing section 100. Moreover, a plane 160 is defined coincident with the second face 148, within which are further defined a first axis D and a second axis E perpendicular to first axis D. The first axis D is perpendicular to the first and third sides 104*a*, 104*c* of the breathing section 100 and parallel to the second and fourth sides 104*b*, 104*d* of the breathing section 100. The second axis E is parallel to the first and third sides 104*a*, 104*c* of the breathing section 100 and perpendicular to the second and fourth sides 104*b*, 104*d* of the breathing section 100.

The lip section 140 of FIGS. 6 and 7, by extending radially from the divergence section 130, creates a high-pressure region that reduces overall airflow through the shroud, especially when coupled with airflow restrictions due to the proximity of the engine 62 (e.g., in the orientation of FIG. 4). Effectively, and referring to FIG. 8, the lip section 140 of FIGS. 6-7 facilitates pressure concentration regions 186 and low pressure regions 188, as shown in a computational fluid dynamics (CFD) simulation of the shroud 68 during operation. Of note, the lip section 140 of FIGS. 6-7 is a non-fastening surface and is solid or continuous (i.e., without apertures or recesses formed wholly or partially in or through either the first or second faces 144, 148) about the centroid C.

Figure 9:
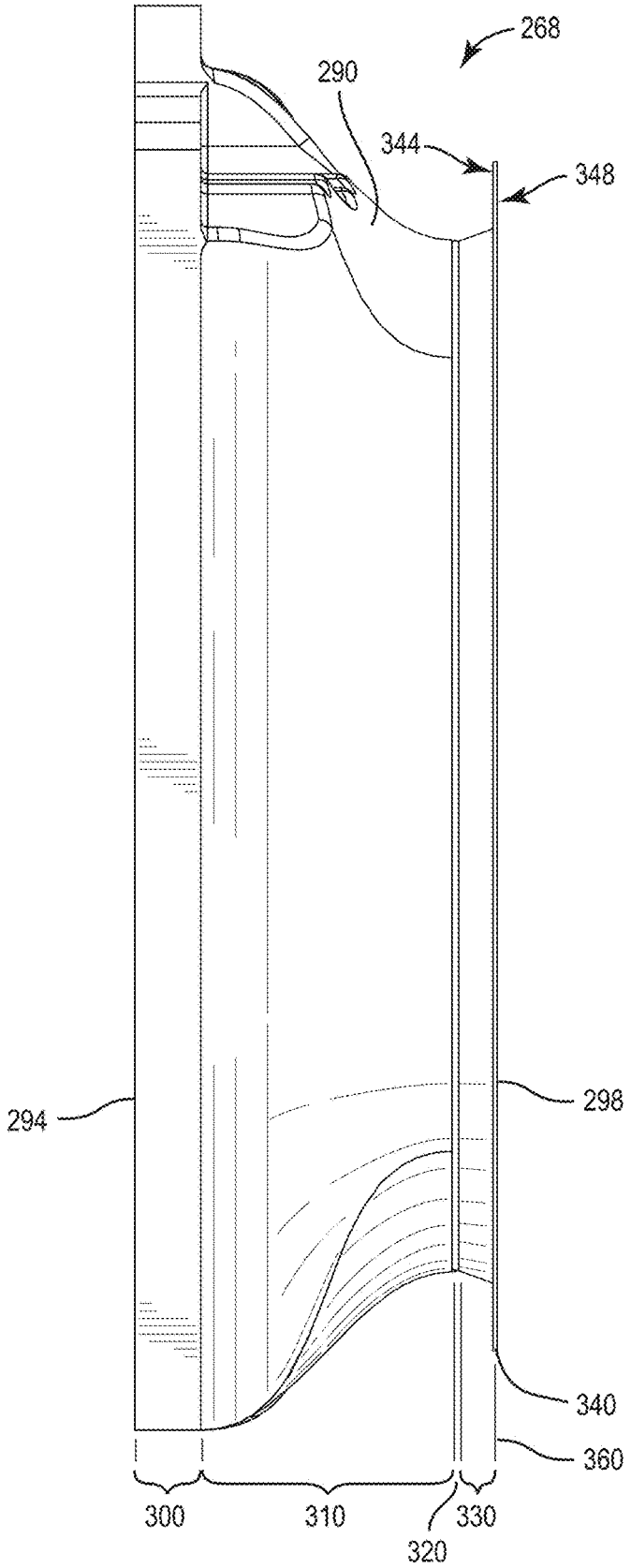
FIG. 9 is a side view of a shroud according to one embodiment.
Figure 10:
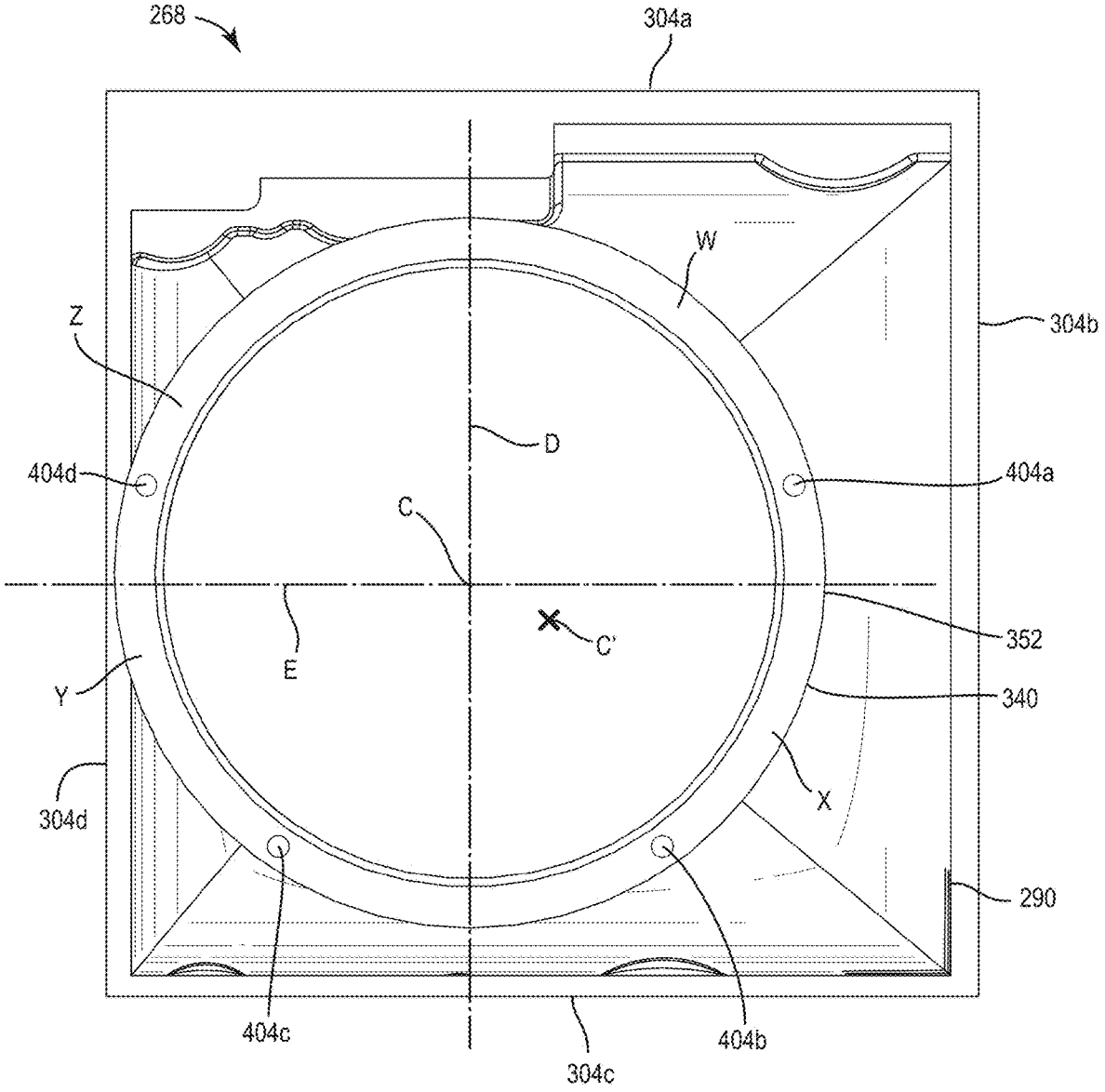
FIG. 10 is a rear view of the shroud of FIG. 9.

FIGS. 9-10 illustrate a shroud 268 according to one embodiment. The shroud 268 of FIGS. 9-10 is similar to the shroud 68 of FIGS. 6-7 discussed above, and therefore like structure will be indicated with the same reference numerals plus 200. In particular, the shroud 268 of FIGS. 9-10 includes a breathing section 300, a convergence section 310, a plateau section 320, a divergence section 330, and a lip section 340, as discussed above.

Further with respect to FIG. 10, a plane 360 is defined coincident with the second face 348 and defines a first axis D and a second axis E, which are perpendicular to each other. The first axis D is perpendicular to the first and third sides 304*a*, 304*c* of the breathing section 300, and parallel to the second and fourth sides 304*b*, 304*d* of the breathing section 300. The second axis E is parallel to the first and third sides 304*a*, 304*c* of the breathing section 100 and perpendicular to the second and fourth sides 304*b*, 304*d* of the breathing section 100. The lip section 340 further includes one or more apertures (i.e., openings) 404 extending therethrough. That is, the apertures 404 extend between the faces 344, 348 of the lip section 340. In the embodiment illustrated in FIGS. 9-10, the apertures 404 are symmetric with respect to the axis D. Moreover, the axes D, E define four quadrants W, X, Y, Z of the lip section 340, with one aperture 404 in each of the four quadrants W, X, Y, Z. In the embodiment illustrated in FIG. 10, the lip section 340 is circular and therefore each quadrant W, X, Y, Z comprises a 90 degree arc length of the lip section 340. In other or additional embodiments, the lip section may have other shapes and therefore each quadrant W, X, Y, Z may comprise other arc lengths. For example, the lip section 340 may be elliptical with non-zero eccentricity or have any other suitable arcuate or curvilinear shape. Moreover, because centroid C of the lip section 340 is offset with respect to the centroid C' of the breathing section 300 (in the view of FIG. 10), quadrant Z (i.e., the quadrant defined in the top left portion of the lip section 340 in the view of FIG. 10) is closest to the intersection of the first side 304*a* and the fourth side 304*d* of the inlet or breathing section 330.

The apertures 404 may also be described as oriented according to degrees of a circle relative to the axis D about the lip section 340 (or the second face 348). In particular, a first aperture 404*a* is oriented between approximately 70 degrees and approximately 90 degrees relative to the axis D (viewed closest to side 304*a* and clockwise therefrom in FIG. 10), and more specifically, the first aperture 404*a* is oriented at approximately 75 degrees relative to the axis D. A second aperture 404*b* is oriented between approximately 130 degrees and approximately 175 degrees relative to the axis D, and more specifically, the second aperture 404*b* is oriented at approximately 140 degrees relative to the axis D. A third aperture 404*c* is oriented between approximately 185 degrees and approximately 235 degrees relative to the axis D, and more specifically, the third aperture 404*c* is oriented at approximately 220 degrees relative to the axis D. A fourth aperture 404*d* is oriented between approximately 270 degrees and approximately 315 degrees relative to the axis D, and more specifically, the fourth aperture 404*d* is oriented at approximately 285 degrees relative to the axis D.

The apertures 404 may also be described relative to one another. In the embodiment illustrated in FIGS. 9-10, the apertures 404 are oriented at least 30 degrees away from one another. The first aperture 404*a* is oriented between approximately 30 degrees and approximately 90 degrees relative to the second aperture 404*b*, and more specifically, the first aperture 404*a* is oriented at approximately 70 degrees relative to the second aperture 404*b*. Accordingly, the arc length distance between the first and second apertures 404*a*, 404*b* measures substantially 495 mm, although in additional or alternative embodiments, the arc length may measure between substantially 210 mm and substantially 640 mm. The second aperture 404*b* is oriented between approximately 30 degrees and approximately 90 degrees relative to the third aperture 404*c*, and more specifically, the second aperture 404*b* is oriented at approximately 70 degrees relative to the third aperture 404*c*. Accordingly, the arc length distance between the second and third apertures 404*b*, 404*c* measures substantially 495 mm, although in additional or alternative embodiments, the arc length may measure between substantially 210 mm and substantially 640 mm. The third aperture 404*c* is oriented between approximately 30 degrees and approximately 90 degrees relative to the fourth aperture 404*d*, and more specifically, the third aperture 404*c* is oriented at approximately 70 degrees relative to the fourth aperture 404*d*. Accordingly, the arc length distance between the third and fourth apertures 404*c*, 404*d* measures substantially 495 mm, although in additional or alternative embodiments, the arc length may measure between substantially 210 mm and substantially 640 mm. The fourth aperture 404*d* is oriented at between approximately 140 degrees and approximately 180 degrees relative to the first aperture 404*a*, and mores specifically, the fourth aperture 404*d* is oriented at approximately 150 degrees relative to the first aperture 404*a*. Accordingly, the arc length distance between the first and fourth apertures 404*a*, 404*d* measures substantially 1060 mm, although in additional or alternative embodiments, the arc length may measure between substantially 990 mm and substantially 1280 mm.

The embodiment of FIG. 10 includes apertures 404 that are substantially circular, although as discussed in greater detail herein, the apertures 404 may be any suitable shape. Additionally, the embodiment of FIG. 10 includes apertures 404 that are substantially the same size, although in other embodiments the aperture may have any suitable size. In the illustrated embodiment, the apertures measure substantially 25.0 mm, although in other or additional embodiments, the apertures may measure between substantially 20.0 mm and substantially 30.0 mm.

Figure 8:
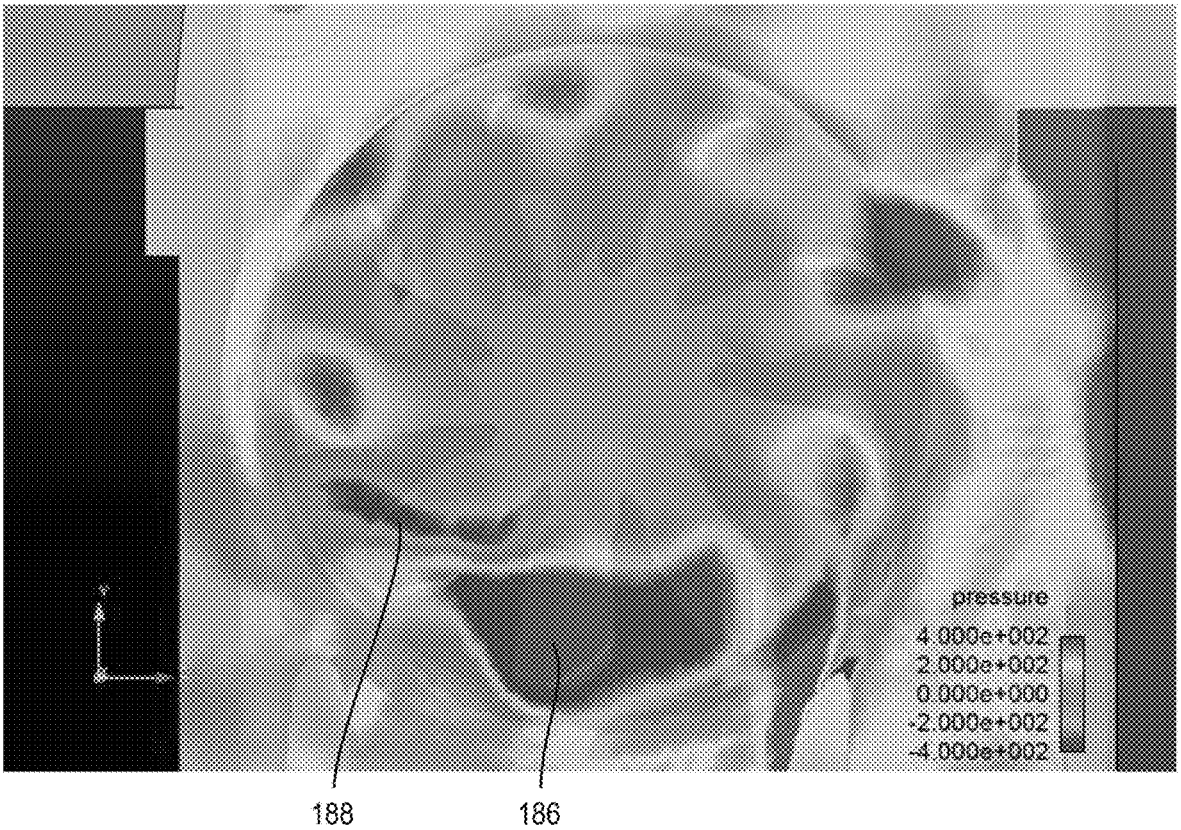
FIG. 8 is a computational fluid dynamics (CFD) simulation of air flow through the shroud of FIG. 7.
Figure 11:
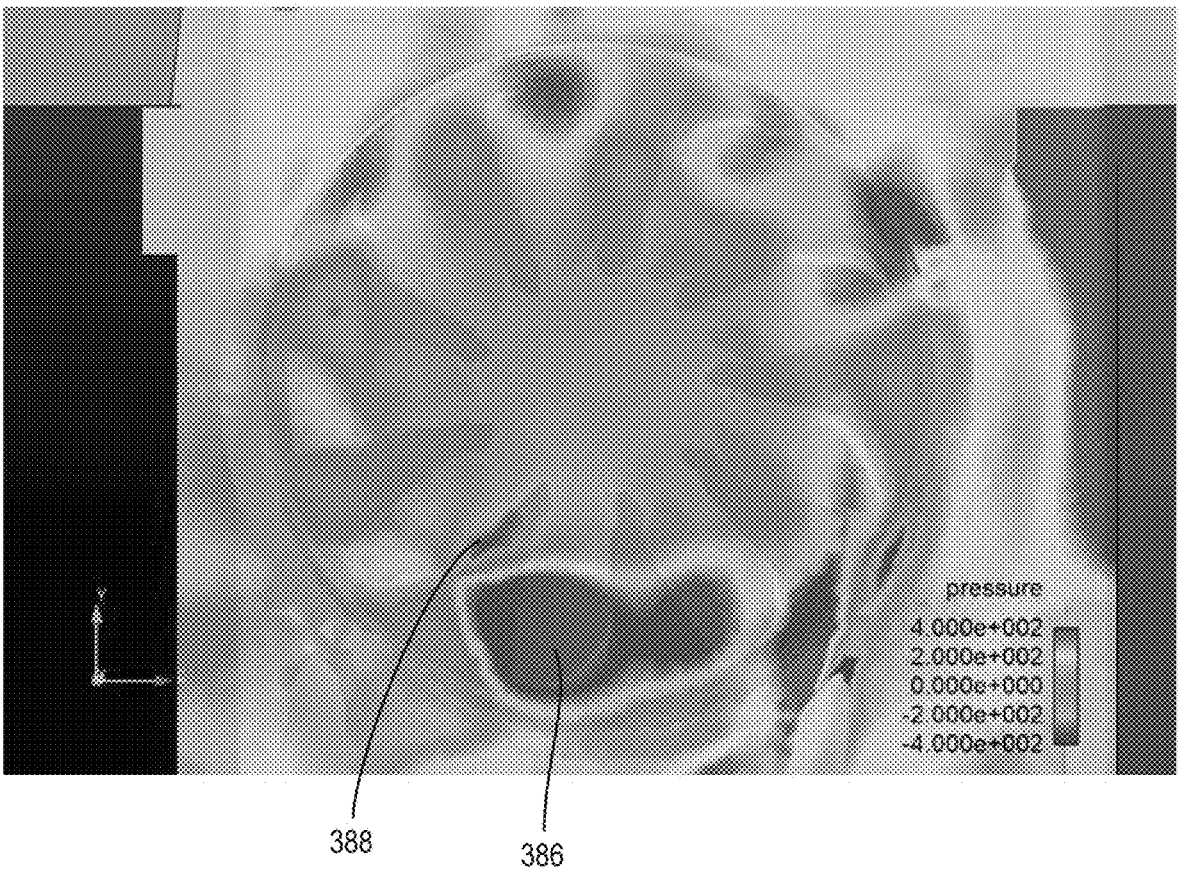
FIG. 11 is a CFD simulation of air flow through the shroud of FIG. 9.

In one embodiment, the apertures 404 of the shroud 268 of FIGS. 9-10 were placed in approximate alignment with the pressure concentration regions 186 previously described with respect to FIG. 8. The CFD results illustrated in FIG. 11 show the pressure distribution during operation at the same downstream planar position of shroud 268 as was illustrated in FIG. 8 with respect to shroud 68 (i.e., near planes 160 and 360). As a result of the presence of the apertures 404, the size and overall intensity of the pressure concentration regions 386 are significantly less intense. In addition, the low-pressure regions 388 in front of the fan 64 are also reduced in intensity. Overall, the pressure distribution in front of the fan 64 is much more homogeneous as indicated by the reduced regions 386, 388. Additionally, the reduced pressure regions 386 represent that airflow is guided more efficiently through the shroud 268 and cooling package 60, which results in more effective cooling of the engine 62.

Figure 12:
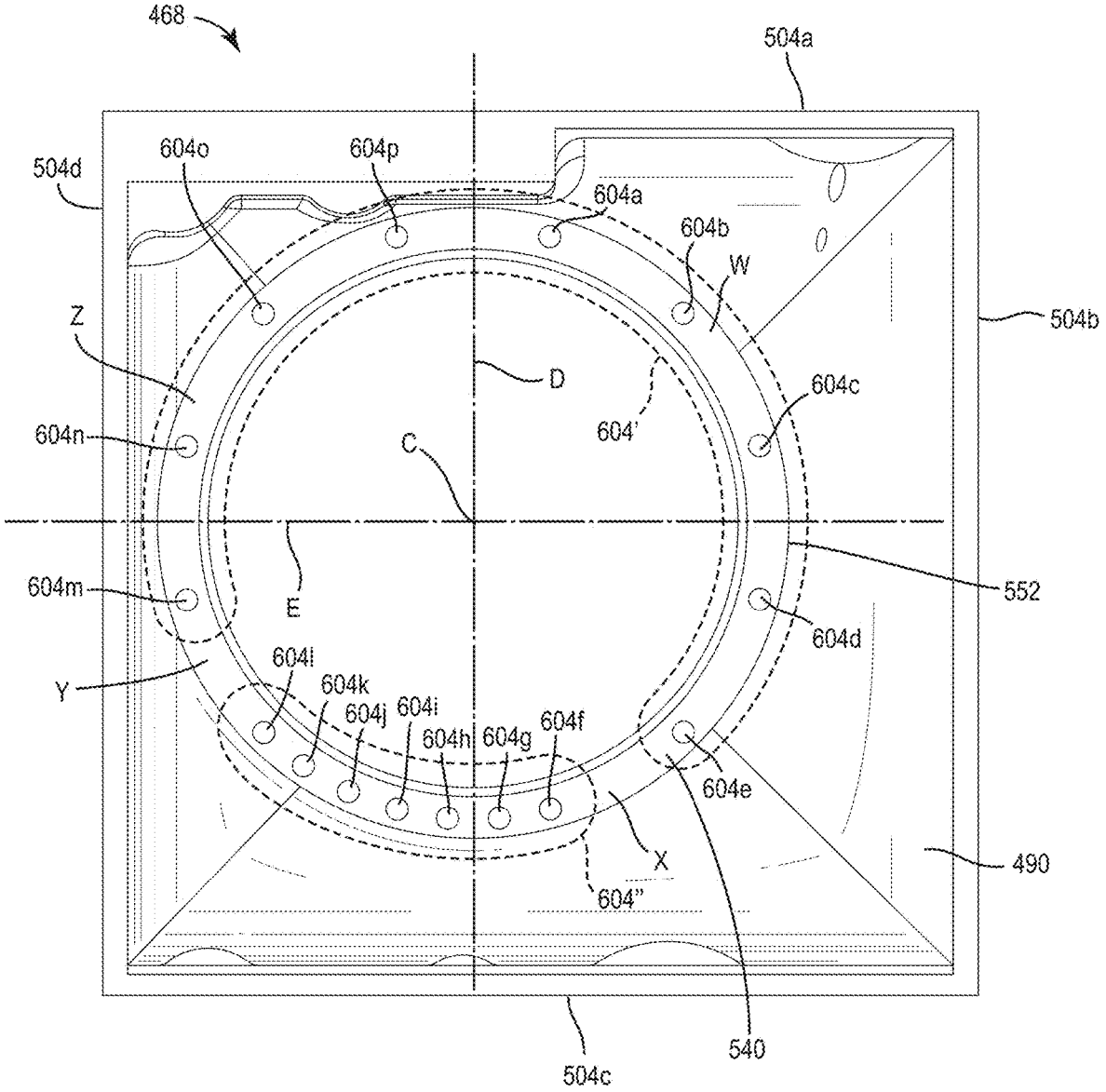
FIG. 12 is a rear view of a shroud according to another embodiment.
Figure 17:
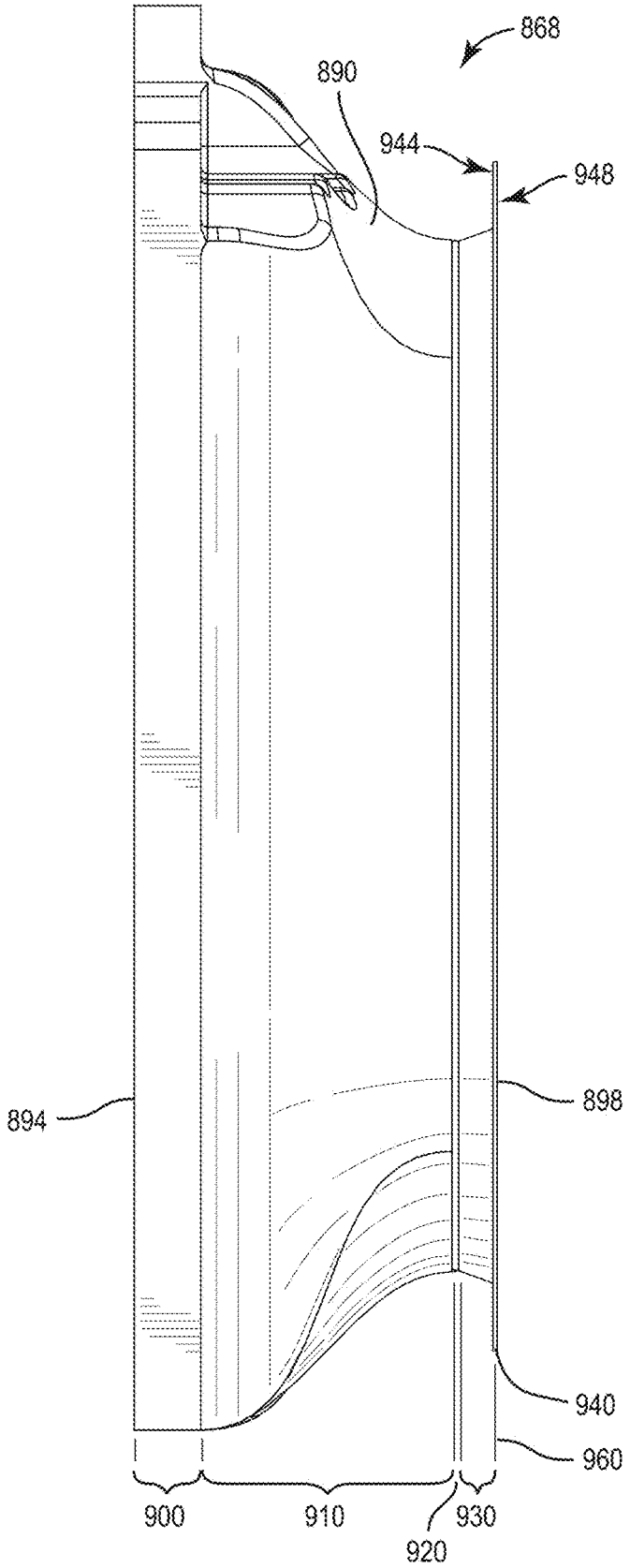
FIG. 17 is a side view of a shroud according to another embodiment.

FIG. 12 shows a shroud 468 according to another embodiment. The shroud 468 of FIG. 17 is similar to the shroud 268 of FIGS. 14-15 discussed herein, and therefore like structure will be indicated with the same reference numerals plus 200. The shroud 468 includes a lip section 540 having a plurality of apertures 604' that are symmetric relative to the axis D and a plurality of apertures 604" that are not symmetric with respect to the axis D. Moreover, the axes D, E define four quadrants W, X, Y, Z of the lip section 540, with a plurality of apertures 604 in each of the four quadrants W, X, Y, Z.

The apertures 604 may also be described as oriented according to degrees of a circle relative to the axis D. In particular, a first aperture 604*a* is oriented between approximately 10 degrees and approximately 20 degrees relative to the axis D (viewed closest to side 504*a* and clockwise therefrom), and more specifically, the first aperture 604*a* is oriented at approximately 15 degrees relative to the axis D. A second aperture 604*b* is oriented between approximately 40 degrees and approximately 50 degrees relative to the axis D, and more specifically, the second aperture 604*b* is oriented at approximately 45 degrees relative to the axis D. A third aperture 604*c* is oriented between approximately 60 degrees and approximately 70 degrees relative to the axis D, and more specifically, the third aperture 604*c* is oriented at approximately 75 degrees relative to the axis D. A fourth aperture 604*d* is oriented between approximately 100 degrees and approximately 110 degrees relative to the axis D, and more specifically, the fourth aperture 604*d* is oriented between approximately 105 degrees relative to the axis D. A fifth aperture 604*e* is oriented between approximately 130 degrees and approximately 140 degrees relative to the axis D, and more specifically, the fifth aperture 604*e* is oriented at approximately 135 degrees relative to the axis D. A sixth aperture 604*f* is oriented between approximately 160 degrees and approximately 170 degrees relative to the axis D, and more specifically, the sixth aperture 604*f* is oriented at approximately 165 degree relative to the axis D. A seventh aperture 604*g* is oriented between approximately 170 degrees and approximately 180 degrees relative to the axis D, and more specifically, the seventh aperture 604*g* is oriented at approximately 175 degrees relative to the axis D. An eighth aperture 604*h* is oriented between approximately 180 degrees and approximately 190 degrees relative to the axis D, and more specifically, the eighth aperture 604*h* is oriented at approximately 185 degrees relative to the axis D. A ninth aperture 604*i* is oriented between approximately 190 degrees and approximately 200 degrees relative to the axis D, and more specifically, the ninth aperture 604*i* is oriented at approximately 195 degrees relative to the axis D. A tenth aperture 604*j* is oriented between approximately 200 degrees and approximately 210 degrees relative to the axis D, and more specifically, the tenth aperture 604*j* is oriented at approximately 205 degrees relative to the axis D. An eleventh aperture 604*k* is oriented between approximately 210 degrees and approximately 220 degrees relative to the axis D, and more specifically, the eleventh aperture 604*k* is oriented at approximately 215 degrees relative to the axis D. A twelfth aperture 604*l* is oriented between approximately 220 degrees and approximately 230 degrees relative to the axis D, and more specifically, the twelfth aperture 604*l* is oriented at approximately 225 degrees relative to the axis D. A thirteenth aperture 604*m* is oriented between approximately 250 degrees and approximately 260 degrees relative to the axis D, and more specifically, the thirteenth aperture 604*m* is oriented at approximately 255 degrees relative to the axis D. A fourteenth aperture 604*n* is oriented between approximately 280 degrees and approximately 290 degrees relative to the axis D, and more specifically, the fourteenth aperture 604*n* is oriented at approximately 285 degree relative to the axis D. A fifteenth aperture 604*o* is oriented between approximately 310 degrees and approximately 320 degrees relative to the axis D, and more specifically, the fifteenth aperture 604*o* is oriented at approximately 315 degrees relative to the axis D. A sixteenth aperture 404*p* is oriented between approximately 340 degrees and approximately 350 degrees relative to the axis D, and more specifically, the sixteenth aperture 604*p* is oriented at approximately 345 degrees relative to the axis D.

The apertures 604 may also be described relative to one another. In the embodiment illustrated in FIG. 12, each of the apertures 604' is oriented at least 30 degrees away from an adjacent aperture 604' and each of the apertures 604" are oriented at least 10 degrees away from an adjacent aperture 604". Accordingly, the arc length distance between the adjacent apertures 604' measures substantially 185 mm, although in additional or alternative embodiments, the arc length may measure between substantially 125 mm and substantially 250 mm. Moreover, the arc length distance between the adjacent apertures 604" measures substantially 60 mm, although in additional or alternative embodiments, the arc length may measure between substantially 30 mm and substantially 95 mm. Further with respect to FIG. 12, the first aperture 604*a* is oriented between approximately 20 degrees and approximately 40 degrees relative to the second aperture 604*b*, and more specifically, the first aperture 604*a* is oriented at approximately 30 degrees relative to the second aperture 604*b*. The second aperture 604*b* is oriented between approximately 20 degrees and approximately 40 degrees relative to the third aperture 604*c*, and more specifically, the second aperture 604*b* is oriented at approximately 30 degrees relative to the third aperture 604*c*. The third aperture 404*c* is oriented between approximately 20 degrees and approximately 40 degrees relative to the fourth aperture 604*d*, and more specifically, the third aperture 404*c* is oriented at approximately 30 degrees relative to the fourth aperture 604*d*. The fourth aperture 604*d* is oriented between approximately 20 degrees and approximately 40 degrees relative to the fifth aperture 604*e*, and more specifically, the fourth aperture 604*d* is oriented at approximately 30 degrees relative to the fifth aperture 604*e*. The fifth aperture 604*e* is oriented between approximately 20 degrees and approximately 40 degrees relative to the sixth aperture 604*f*, and more specifically, the fifth aperture 604*e* is oriented at approximately 30 degrees relative to the sixth aperture 604*f*. The sixth aperture 604*f* is oriented between approximately 5 degrees and approximately 15 degrees relative to the seventh aperture 604*g*, and more specifically, the sixth aperture 604*f* is oriented at approximately 10 degrees relative to the seventh aperture 604*g*. The seventh aperture 604*g* is oriented between approximately 5 degrees and approximately 15 degrees relative to the eighth aperture 604*h*, and more specifically, the seventh aperture 604*g* is oriented at approximately 10 degrees relative to the eighth aperture 604*h*. The eighth aperture 604*h* is oriented between approximately 5 degrees and approximately 15 degrees relative to the ninth aperture 604*i*, and more specifically, the eighth aperture 604*h* is oriented at approximately 10 degrees relative to the ninth aperture 604*i*. The ninth aperture 604*i* is oriented between approximately 5 degrees and approximately 15 degrees relative to the tenth aperture 604*j*, and more specifically, the ninth aperture 604*i* is oriented at approximately 10 degrees relative to the tenth aperture 604*j*. The tenth aperture 604*j* is oriented between approximately 5 degrees and approximately 15 degrees relative to the eleventh aperture 604*k*, and more specifically, the tenth aperture 604*j* is oriented at approximately 10 degrees relative to the eleventh aperture 604*k*. The eleventh aperture 604*k* is oriented between approximately 5 degrees and approximately 15 degrees relative to the twelfth aperture 604*l*, and more specifically, the eleventh aperture 604*k* is oriented at approximately 10 degrees relative to the twelfth aperture 604*l*. The twelfth aperture 604*l* is oriented between approximately 20 degrees and approximately 40 degrees relative to the thirteenth aperture 604*m*, and more specifically, the twelfth aperture 604*l* is oriented at approximately 30 degrees relative to the thirteenth aperture 604*m*. The thirteenth aperture 604*m* is oriented between approximately 20 degrees and approximately 40 degrees relative to the fourteenth aperture 604*n*, the thirteenth aperture 604*m* is oriented at approximately 30 degrees relative to the fourteenth aperture 604*n*. The fourteenth aperture 604*n* is oriented between approximately 20 degrees and approximately 40 degrees relative to the fifteenth aperture 604*o*, and more specifically, the fourteenth aperture 604*n* is oriented at approximately 30 degrees relative to the fifteenth aperture 604*o*. The fifteenth aperture 604*o* is oriented between approximately 20 degrees and approximately 40 degrees relative to the sixteenth aperture 604*p*, and more specifically, the fifteenth aperture 604*o* is oriented at approximately 30 degrees relative to the sixteenth aperture 604*p*. The sixteenth aperture 604*p* is oriented between approximately 20 degrees and approximately 40 degrees relative to the first aperture 604*a*, and more specifically, the sixteenth aperture 604*p* is oriented at approximately 30 degrees relative to the first aperture 604*a*.

The embodiment of FIG. 12 includes apertures 604 that are substantially circular, although as discussed in greater detail herein, the apertures 604 may be any suitable shape. Additionally, the embodiment of FIG. 12 includes apertures 604 that are substantially the same size, although in other embodiments the aperture may have any suitable size. In the illustrated embodiment, the apertures measure substantially 25.0 mm, although in other or additional embodiments, the apertures may measure between substantially 20.0 mm and substantially 30.0 mm.

Figure 13:
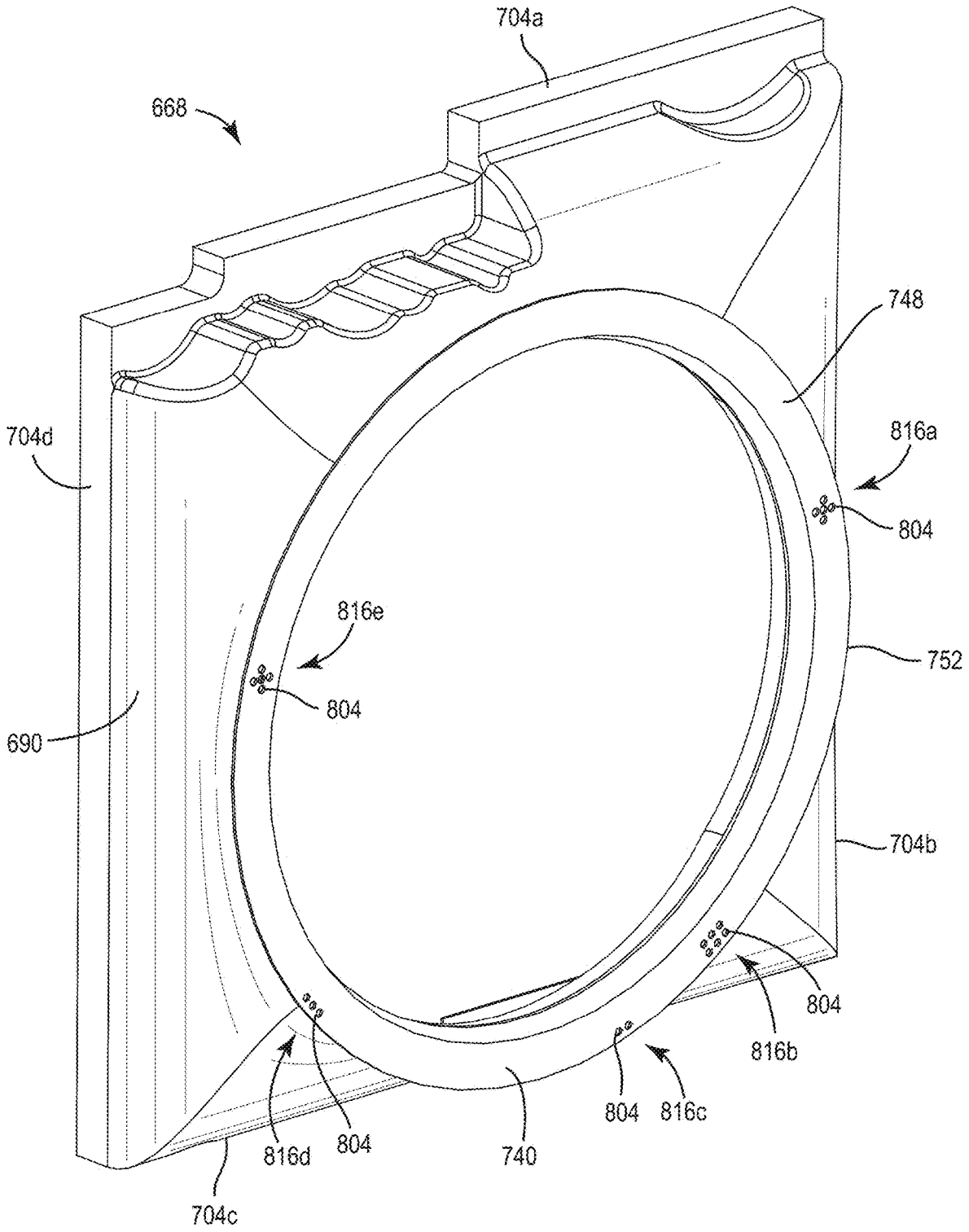
FIG. 13 is a perspective view of a shroud according to another embodiment.
Figure 14:
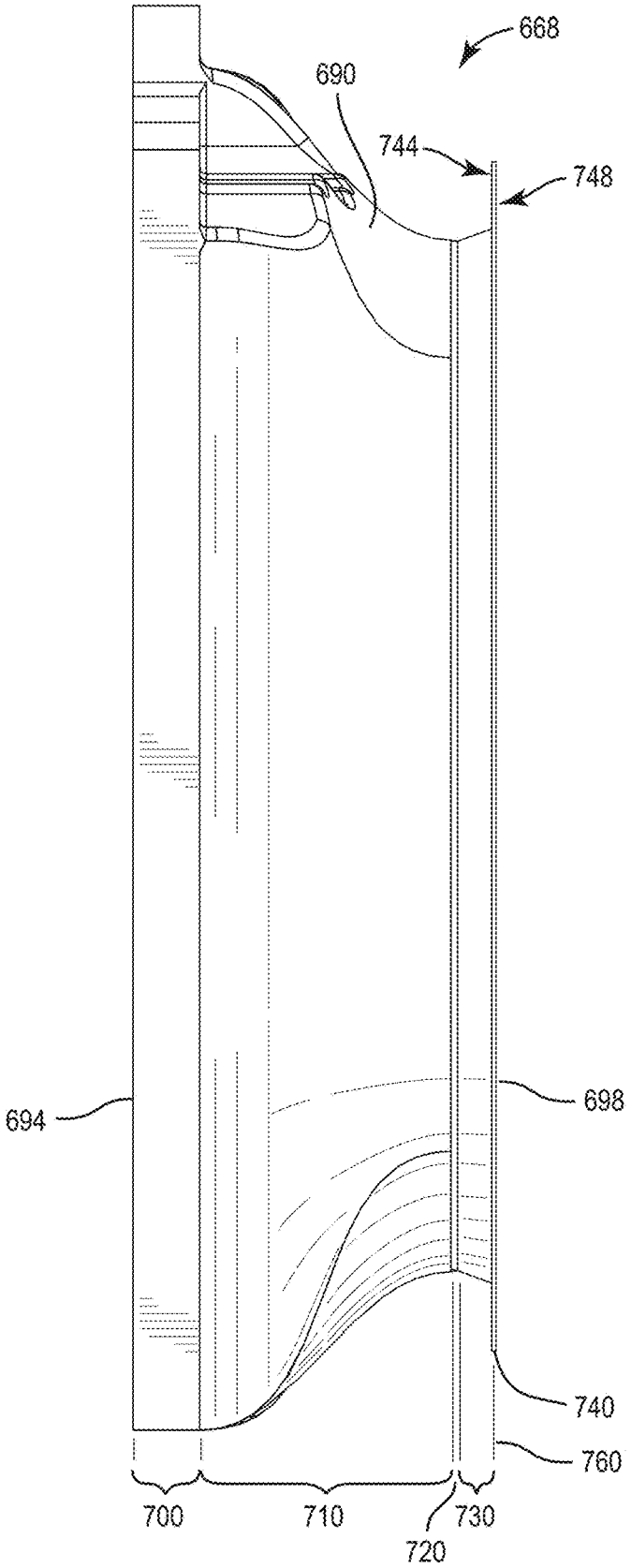
FIG. 14 is a side view of the shroud of FIG. 13.
Figure 15:
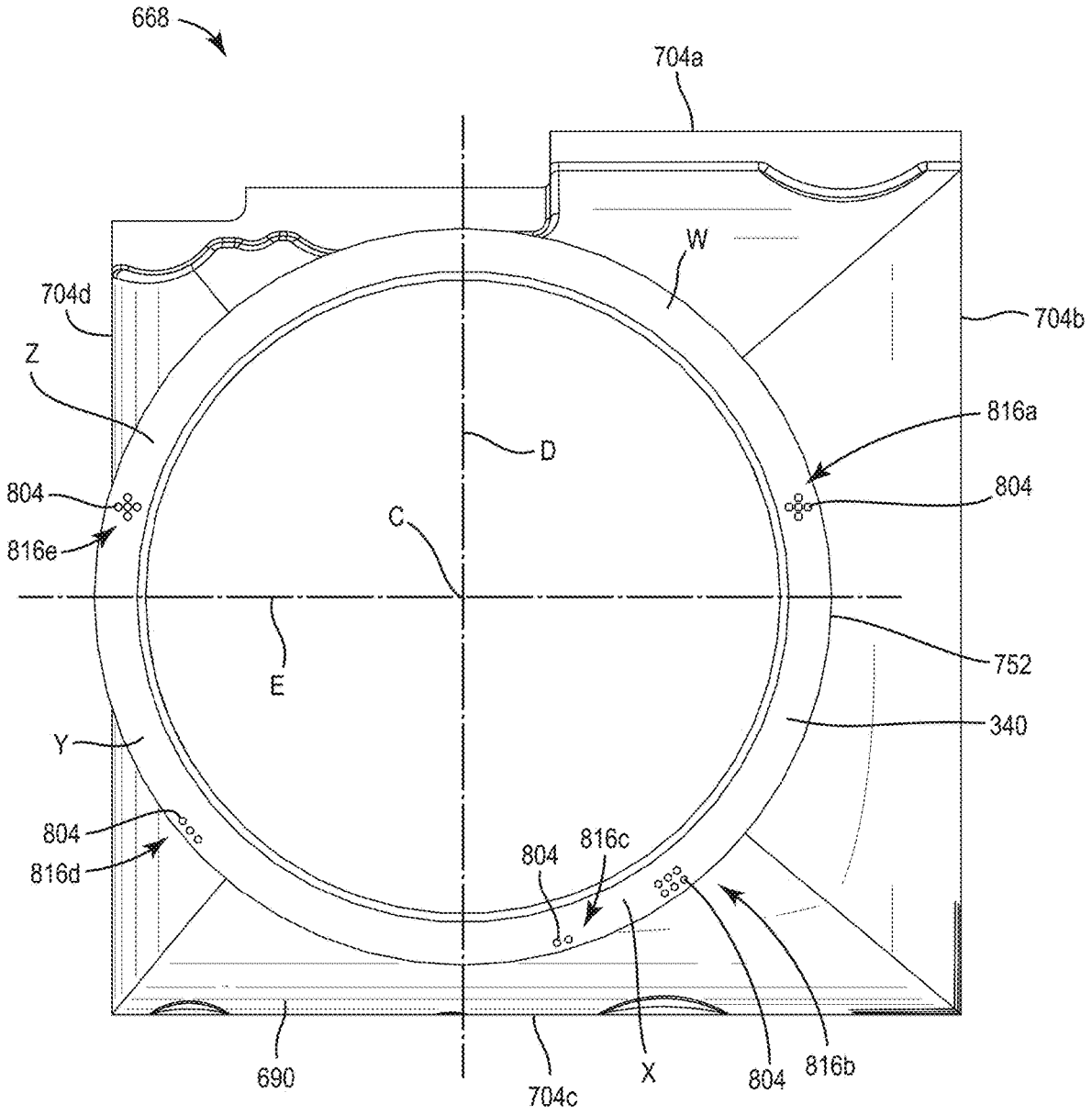
FIG. 15 is a rear view of the shroud of FIG. 13.

FIGS. 13-15, illustrate a shroud 668 according to another embodiment. The shroud 668 of FIGS. 13-15 is similar to the shroud 268 of FIGS. 9-10 discussed above, and therefore like structure will be indicated with the same reference numerals plus 400, to include the existence of axis D and axis E. In the embodiment illustrated in FIGS. 13-15, the apertures 804 are arranged in clusters 816. In particular, the lip section 740 has a first cluster 816*a* of five apertures 804 in quadrant W, a second cluster 816*b* including six apertures 804 in quadrant X, a third cluster 816*c* including two apertures 804 in quadrant X, a fifth cluster 816*d* including three apertures 804 in quadrant Y, and a fifth cluster 816*e* including five apertures 804 in quadrant Z. The first and fifth clusters 816*a*, 816*e* are symmetric with respect to the axis D, and the second, third, and fourth clusters 816*b*, 816*c*, 816*d* are asymmetric with respect to the axis D.

The apertures 804 may also be described as oriented according to degrees of a circle relative to the axis D. In particular, the first cluster 816*a* is centered between approximately 70 degrees and approximately 90 degrees relative to the axis D (viewed closest to side 704*a* and clockwise therefrom), and more specifically, the first cluster 816*a* is centered at approximately 75 degrees relative to the axis D. The second cluster 816*b* is centered between approximately 130 and approximately 175 degrees relative to the axis D, and more specifically, the second cluster 816*b* is centered at approximately 140 degrees relative to the axis D. The third cluster 816*c* is centered between approximately 160 degrees and approximately 190 degrees relative to the axis D, and more specifically, the third cluster 816*c* is centered at approximately 165 degrees relative to the D axis. The fourth cluster 816*d* is centered between approximately 185 degrees and approximately 235 degrees relative to the axis D, and more specifically, the fourth cluster 816*d* is centered at approximately 225 degrees relative to the axis D. The fifth cluster 816*e* is centered between approximately 270 degrees and approximately 315 degrees relative to the axis D, and more specifically, and the fifth cluster 816*e* is centered at approximately 285 degrees relative to the axis D.

The apertures 804 may also be described relative to one another. In the embodiment illustrated in FIGS. 13-15, the centers of the clusters 816 are oriented at least 10 degrees away from one another. That is, a center of the first cluster 816*a* is oriented between approximately 40 degrees and approximately 70 degrees relative to a center of the second cluster 816*b*, and more specifically, the center of the first cluster 816*a* is oriented at approximately 65 degrees relative to the center of the second cluster 816*b*. Accordingly, the arc length distance between the centers of the first and second clusters 816*a*, 816*b* measures substantially 460 mm, although in additional or alternative embodiments, the arc length may measure between substantially 280 mm and substantially 500 mm. The center of the second cluster 816*b* oriented between approximately 5 degrees and approximately 35 degrees relative to a center of the third cluster 816*c*, and more specifically, the center of the second cluster 816*b* is oriented at approximately 15 degrees relative to the center of the third cluster 816*c*. Accordingly, the arc length distance between the centers of the second and third clusters 816*b*, 816*c* measures substantially 105 mm, although in additional or alternative embodiments, the arc length may measure between substantially 35 mm and substantially 250 mm. The center of the third cluster 816*c* is oriented between approximately 50 degrees and approximately 80 degrees relative to a center of the fourth cluster 816*d*, and more specifically, the center of the third cluster 816*c* is oriented at approximately 60 degrees relative to the center of the fourth cluster 816*d*. Accordingly, the arc length distance between the centers of the third and fourth clusters 816*c*, 816*d* measures substantially 425 mm, although in additional or alternative embodiments, the arc length may measure between substantially 350 mm and substantially 570 mm. The center of the fourth cluster 816*d* is oriented between approximately 40 degrees and approximately 70 degrees relative to a center of the fifth cluster 816*e*, and more specifically, the center of the fourth cluster 816*d* is oriented at approximately 60 degrees relative to the center of the fifth cluster 816*e*. Accordingly, the arc length distance between the centers of the fourth and fifth clusters 816*d*, 816*e* measures substantially 460 mm although in additional or alternative embodiments, the arc length may measure between substantially 280 mm and substantially 500 mm. The center of the fifth cluster 816*e* is oriented between approximately 140 degrees and approximately 180 degrees relative to the center of the first cluster 816*a*, and more specifically, the center of the fifth cluster 816*e* is oriented at approximately 150 degrees relative to the center of the first cluster 816*a*. Accordingly, the arc length distance between the centers first and fifth clusters 816*a*, 816*e* measures substantially 1065 mm, although in additional or alternative embodiments, the arc length may measure between substantially 990 mm and substantially 1280 mm.

Moreover, the embodiment of FIGS. 13-15 includes clusters 816 that are arranged in a "+" shaped configuration (i.e., the first and fifth clusters 816*a*, 816*e*), a line configuration (i.e., the fourth and fifth clusters 816*d*, 816*e*), and a double-line configuration (i.e., the third cluster 816*c*). The apertures 804 may have other shapes, sizes, and cluster configurations. In the illustrated embodiment, the apertures of clusters 816*a*-816*e* measure substantially 9.0 mm. Moreover, the width and height (measured between the centers of the apertures) of clusters 816*a*, 816*e* measure substantially 11.0 mm. Alternatively, the apertures of the clusters 816*b*-816*d* may be hexagonal. In particular, the hexagonal apertures may be 120-degree equal sided hexagons having sides with lengths measuring substantially 4.5 mm. Hexagonal apertures are spaced apart from one another by substantially 4.5 mm gaps. The apertures of clusters 816*a*-816*e* are spaced apart from an inside edge of the lip section 740 by substantially 6.0 mm.

Like the apertures 404 of the shroud 268, the apertures 804 of the shroud 668 reduce the pressure concentration regions created by the lip section 740 and increase airflow. As shown in Table 1, below, the shroud 668 illustrated in FIGS. 13-15 having the configuration of apertures 804 and clusters 816 discussed above provides an increase in airflow in comparison to the shroud 68 of FIGS. 6-7, which has no apertures.

TABLE 1

| Shroud Design | Airflow through shroud [$m^3$/min] |
|---|---|
| Shroud 68 of FIGS. 6-7 | 290.134 |
| Shroud 668 of FIGS. 13-15 | 298.913 |

The airflow of Table 1 was generated by a simulation that defined a fan speed of 1893 RPM, the maximum rated speed during normal operation.

Figure 16:
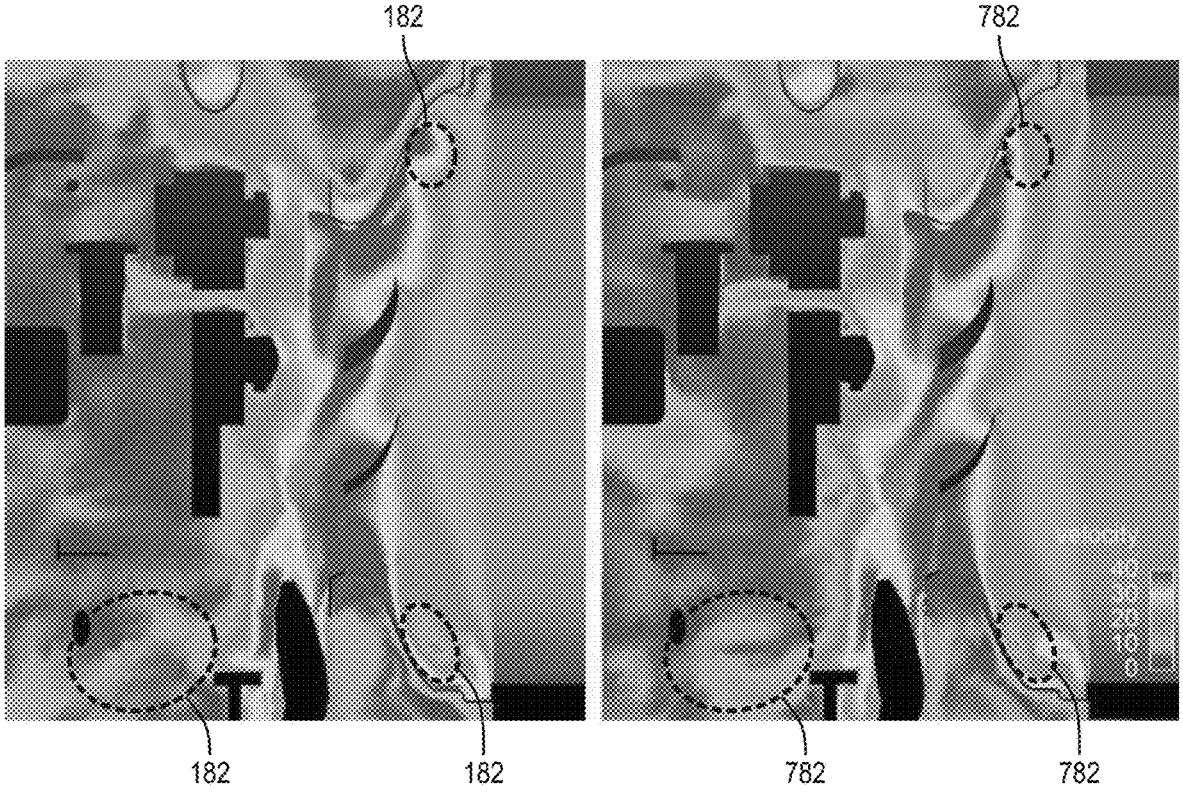
FIG. 16 is a CFD simulation comparing airflow through the shroud of FIG. 6 to airflow through the shroud of FIG. 14.

As shown in FIG. 16, the pressure and velocity fields near the shroud outlet 98, 698 were also analyzed for both the shroud 68 of the prior art shown in FIGS. 6-7 and the shroud 668 shown in FIGS. 13-15. In comparing the CFD results in FIG. 16, the high-speed vortices 182, 782 in the upper region and the low-speed vortices 182, 782 in the lower region of the shroud 68, 668 are suppressed in the shroud 668 of FIGS. 13-15 as compared to the shroud 68 of FIGS. 6-7.

Figure 18:
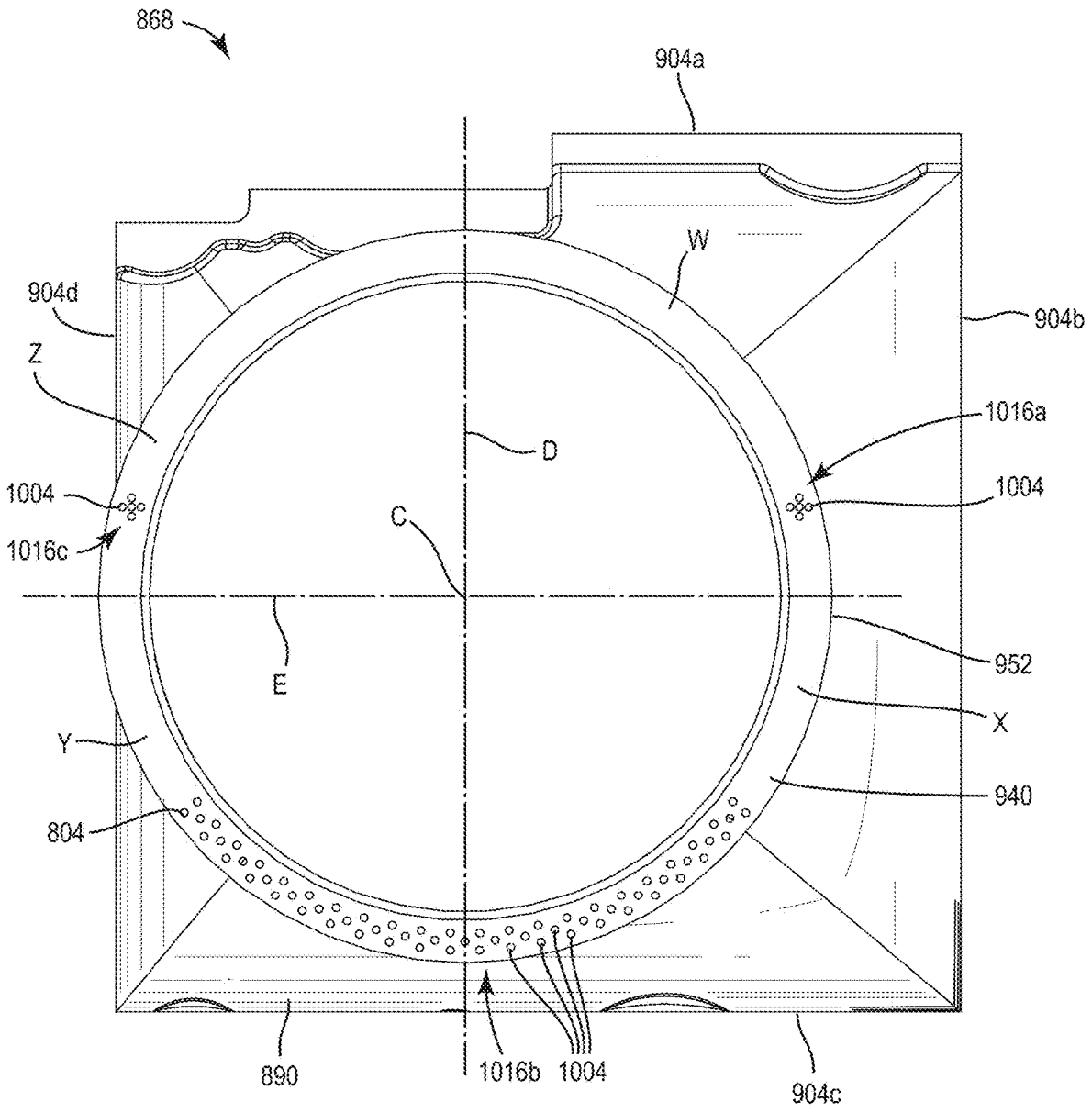
FIG. 18 is a rear view of the shroud of FIG. 17.

FIGS. 17-18 show a shroud 868 according to another embodiment. The shroud 868 of FIGS. 17-18 is similar to the shroud 268 of FIGS. 9-10 discussed above, and therefore like structure will be indicated with the same reference numerals plus 600. The lip section 940 has a first cluster 1016*a* of five apertures 1004, a second cluster 1016*b* including a plurality of apertures 1004, and a third cluster 1016*c* including five apertures 1004. The first cluster 1016*a* is positioned in quadrant W and the third cluster 1016*c* is positioned in quadrant Z. The second cluster 1016*b* is positioned in and extends between quadrants X and Z. As shown in FIG. 18, the first and third clusters 1016*a*, 1016*c* are symmetric with respect to the axis D.

The apertures 1004 may also be described as oriented according to degrees of a circle relative to the axis D. In particular, the first cluster 1016*a* is centered between approximately 70 degrees and approximately 90 degrees relative to the axis D (viewed closest to side 904*a* and clockwise therefrom), and more specifically, the first cluster 1016*a* is centered at approximately 75 degrees relative to the axis D. The second cluster 1016*b* is centered between approximately 170 degrees and approximately 190 degrees relative to the D axis, and more specifically, the second cluster 1016*b* extends between approximately 130 and approximately 235 degrees relative to the axis D. The third cluster 1016*c* is centered between approximately 270 degrees and approximately 315 degrees relative to the axis D, and more specifically, the third cluster 1016*c* is centered at approximately 285 degrees relative to the axis D.

The apertures 1004 may also be described relative to one another. In the embodiment illustrated in FIGS. 17-18, the clusters 1016 are oriented at least 30 degrees away from one another. That is, a center of the first cluster 1016*a* is oriented between approximately 90 degrees and approximately 110 degrees relative to a center of the second cluster 1016*b*, and more specifically, the center of the first cluster 1016*a* is oriented at approximately 105 degrees relative to the center of the second cluster 1016*b*. Moreover, a center of the first cluster 1016*a* is oriented at approximately 52 degrees relative to an edge of the second cluster 1016*b*. Accordingly, the arc length distance between the center of the first cluster 1016*a* and an edge of the second cluster 1016*b* measures substantially 370 mm, although in additional or alternative embodiments, the arc length may measure between substantially 295 mm and substantially 440 mm. The center of the second cluster 1016*b* oriented between approximately 90 degrees and approximately 110 degrees relative to a center of the third cluster 1016*c*, and more specifically, the center of the second cluster 1016*b* is oriented at approximately 105 degrees relative to the center of the third cluster 1016*c*. Moreover, an edge of the second cluster 1016*b* is oriented at approximately 52 degrees relative to the center of the third cluster 1016*c*. Accordingly, the arc length distance between the edge of the second cluster 1016*b* and the center of the third cluster 1016*c* measures substantially 370 mm, although in additional or alternative embodiments, the arc length may measure between substantially 295 mm and substantially 440 mm. The center of the third cluster 1016*c* is oriented between approximately 140 degrees and approximately 180 degrees relative to the center of the first cluster 1016*a*, and more specifically, the center of the third cluster 1016*c* is oriented at approximately 150 degrees relative to the center of the first cluster 1016*a*. Accordingly, the arc length distance between the centers first and third clusters 1016*a*, 1016*c* measures substantially 1065 mm, although in additional or alternative embodiments, the arc length may measure between substantially 990 mm and substantially 1280 mm.

The embodiment of FIGS. 17-18 includes apertures 1004 that are substantially circular. Moreover, the embodiment of FIGS. 17-18 includes clusters 1016 that are arranged in a "+" shaped configuration (i.e., first and third clusters 1016*a*, 1016*c*) and that are arranged in a staggered configuration (i.e., second cluster 1016*b*). The apertures 1004 may have other shapes, sizes, and cluster configurations. In the illustrated embodiment, the apertures of clusters 1016*a*, 1016*c* measure substantially 9.0 mm. Moreover, the width and height (measured between the centers of the apertures) of clusters 1016*a*, 1016*c* measure substantially 11.0 mm. The apertures of cluster 1016*b* measure substantially 9.0 mm. Further, a distance between apertures in the same row (measured center-to-center) is substantially 20.0 mm. Moreover, the apertures are positioned relative to one another at 60-degree angles.

Figure 19:
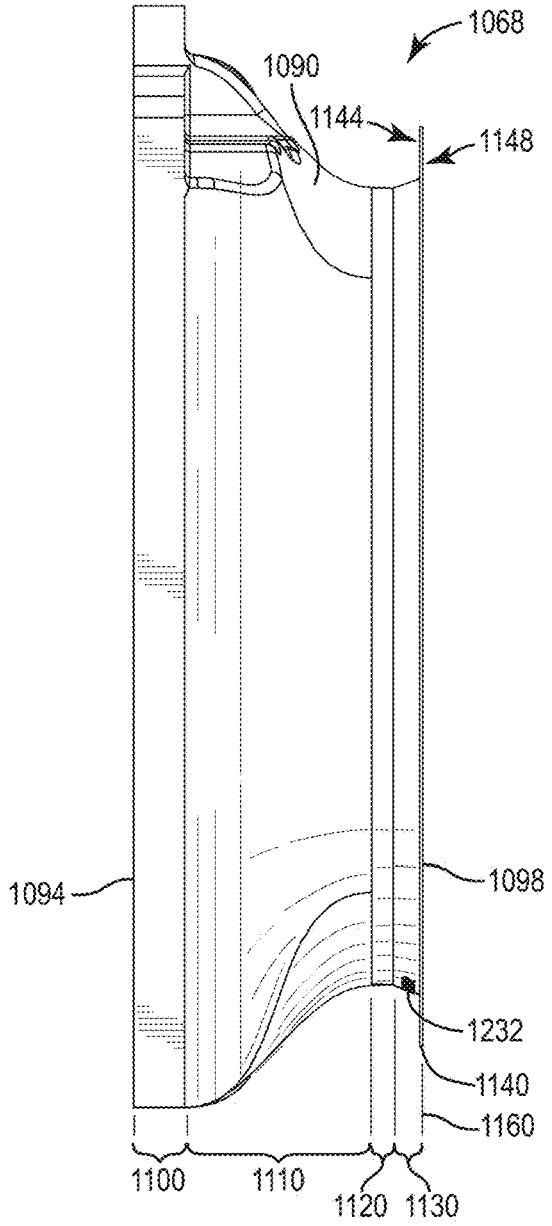
FIG. 19 is a side view of a shroud according to another embodiment.
Figure 20:
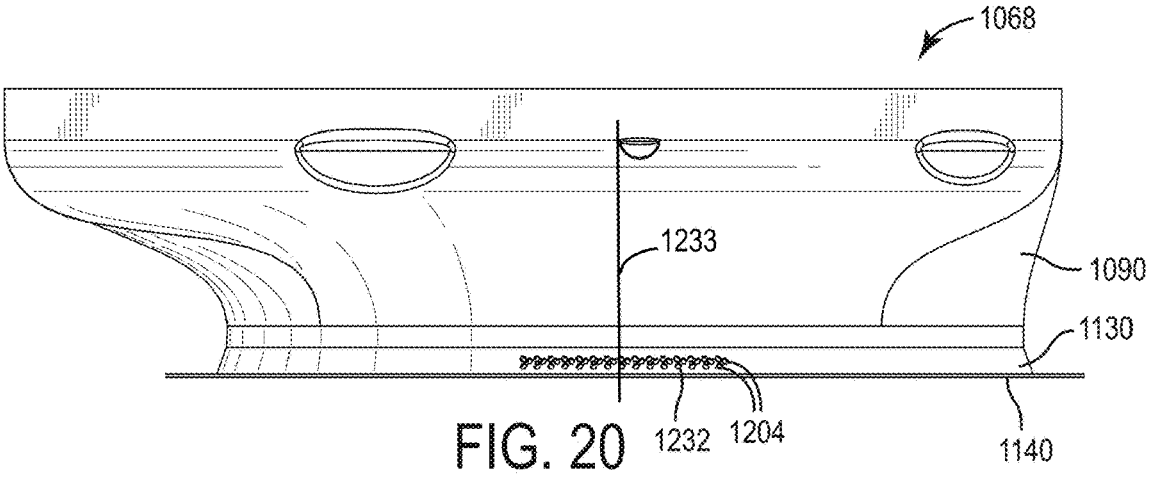
FIG. 20 is another side view of the shroud of FIG. 19.
Figure 21:
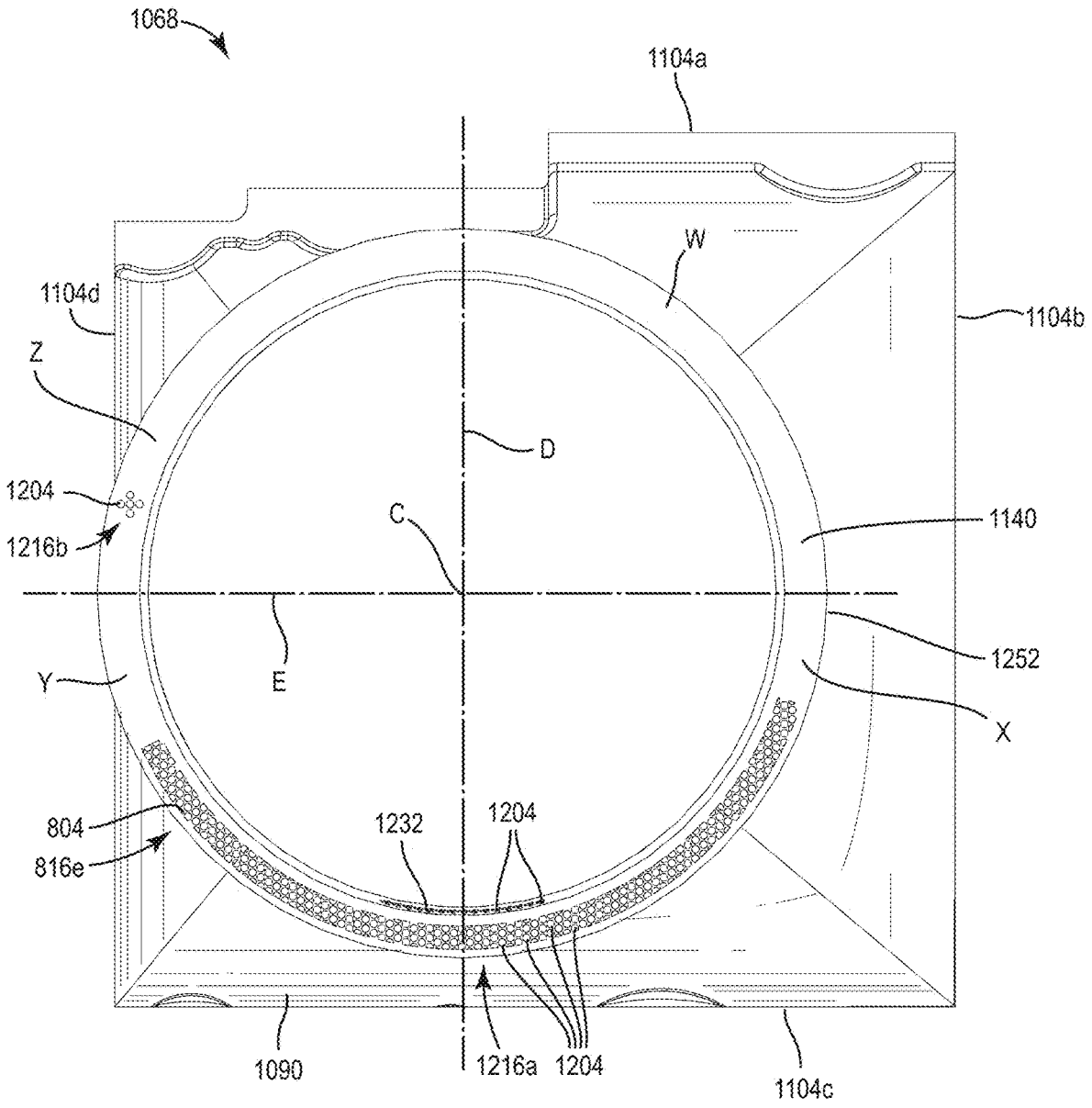
FIG. 21 is a rear view of the shroud of FIG. 19.

FIGS. 19-21 show a shroud 1068 according to another embodiment. The shroud 1068 of FIGS. 19-21 is similar to the shroud 268 of FIGS. 9-10 discussed above, and therefore like structure will be indicated with the same reference numerals plus 800. In the embodiment illustrated in FIGS. 24-26, the lip section 1140 has a first cluster 1216 including a plurality of apertures 1204 and a second cluster 1016*b* of five apertures 1204. The first cluster 1216*a* is positioned in and extends between quadrants X and Y and the second cluster 1216*b* is positioned in quadrant Z. In the embodiment of FIGS. 19-21, the divergence section 1130 has apertures 1204 that are arranged in a third cluster 1232, as well.

Further, the apertures 1204 may also be described as oriented according to degrees of a circle relative to the axis D. In particular, the first cluster 1216*a* is centered between approximately 170 degrees and approximately 190 degrees relative to the D axis (viewed closest to side 1104*a* and clockwise therefrom), and more specifically, the first cluster 1216*a* extends between approximately 110 and approximately 245 degrees relative to the axis D. The second cluster 1216*b* is centered between approximately 270 degrees and approximately 315 degrees relative to the axis D, and more specifically, the second cluster 1216*b* is centered at approximately 285 degrees relative to the axis D. The divergence section 1130 is substantially concentric with the lip section 1140. Accordingly, the third cluster 1232 is centered between approximately 170 degrees and approximately 190 degrees relative to the D axis, and more specifically, the third cluster 1232 extends between approximately 165 degrees and approximately 195 degrees relative to the axis D. The apertures of the third cluster 1232 are hexagons. The hexagons are spaced (center-to-center) substantially 2 mm apart. Also, the hexagonal apertures are positioned in groups of the three and patterned at a two degree offset around a centerline 1233 of the shroud. Moreover, the hexagonal apertures have two sides that measure substantially 3.5 mm and the height between these two sides measures substantially 5.0 mm. That is, the apertures extend substantially 95 mm in one direction from the centerline 1233 and substantially 100 mm in the opposite direction from the centerline 1233. Accordingly, the apertures of the third cluster 1232 extend substantially 195 mm along the arc length of the divergence section 1130. The hexagonal apertures of the third cluster 1232 are additionally positioned substantially 7.0 mm from an edge of divergence section 1130.

The apertures 1204 may also be described relative to one another. That is, a center of the first cluster 1216*a* is oriented between approximately 90 degrees and approximately 110 degrees relative to a center of the second cluster 1216*b*, and more specifically, the center of the first cluster 1216*a* is oriented at approximately 105 degrees relative to the center of the second cluster 1216*b*. Moreover, an edge of the first cluster 1216*a* is oriented at approximately 40 degrees relative to the center of the second cluster 1216*b*. Accordingly, the arc length distance between the edge of the first cluster 1216*a* and the center of the second cluster 1216*b* measures substantially 280 mm, although in additional or alternative embodiments, the arc length may measure between substantially 210 mm and substantially 425 mm. The center of the second cluster 1216*b* is oriented between approximately 240 degrees and approximately 270 degrees relative to the center of the first cluster 1216*a*, and more specifically, the center of the second cluster 1216*b* is oriented at approximately 255 degrees relative to the center of the first cluster 1216*a*. Moreover, a center of the second cluster 1216*b* is oriented at approximately 185 degrees relative to an edge of the first cluster 1216*a*. Accordingly, the arc length distance between the center of the second cluster 1216*b* and an edge of the first cluster 1216*a* measures substantially 1310 mm, although in additional or alternative embodiments, the arc length may measure between substantially 1240 mm and substantially 1385 mm.

The embodiment of FIGS. 19-21 includes apertures 1204 that are substantially circular. Moreover, the embodiment of FIGS. 19-21 includes clusters 1216 that are arranged in a "+" shaped configuration (i.e., second cluster 1216*b*) and that are arranged in a staggered configuration (i.e., first and third clusters 1216*a*, 1232). The apertures 1204 may have other shapes, sizes, and cluster configurations. In the illustrated embodiment, the apertures of cluster 1216*b* measures substantially 9.0 mm. Moreover, the width and height (measured between the centers of the apertures) of cluster 1216*b* measures substantially 11.0 mm. The apertures of cluster 1216*a* measure substantially 9.0 mm and the distance between adjacent apertures (measured center-to-center) is substantially 11.0 mm. The apertures are centered on the lip section 1140 and are positioned at least 10.0 mm away from both inside and outside edges of the lip section 1140.

Figure 22:
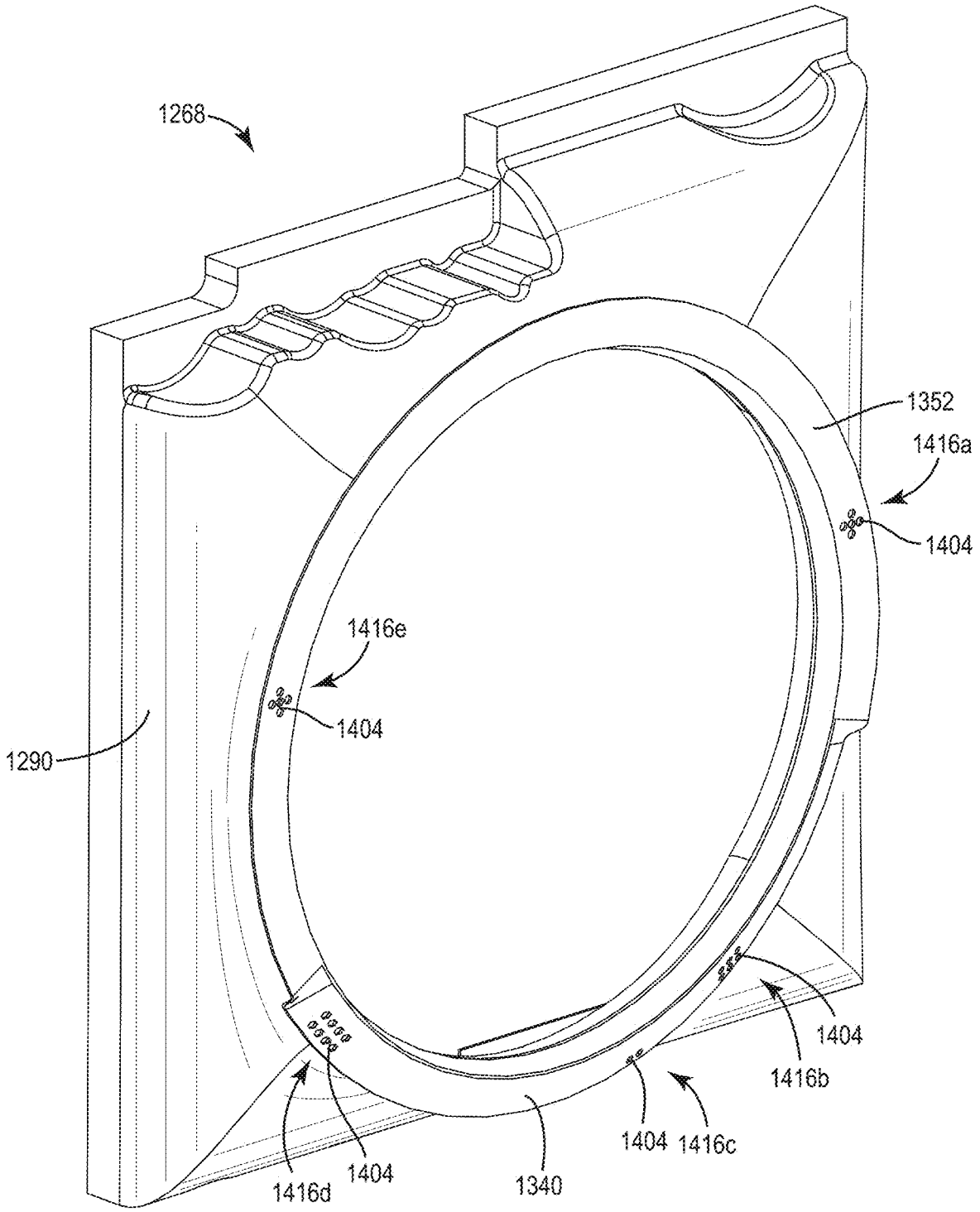
FIG. 22 is a perspective view of a shroud according to another embodiment.
Figure 23:
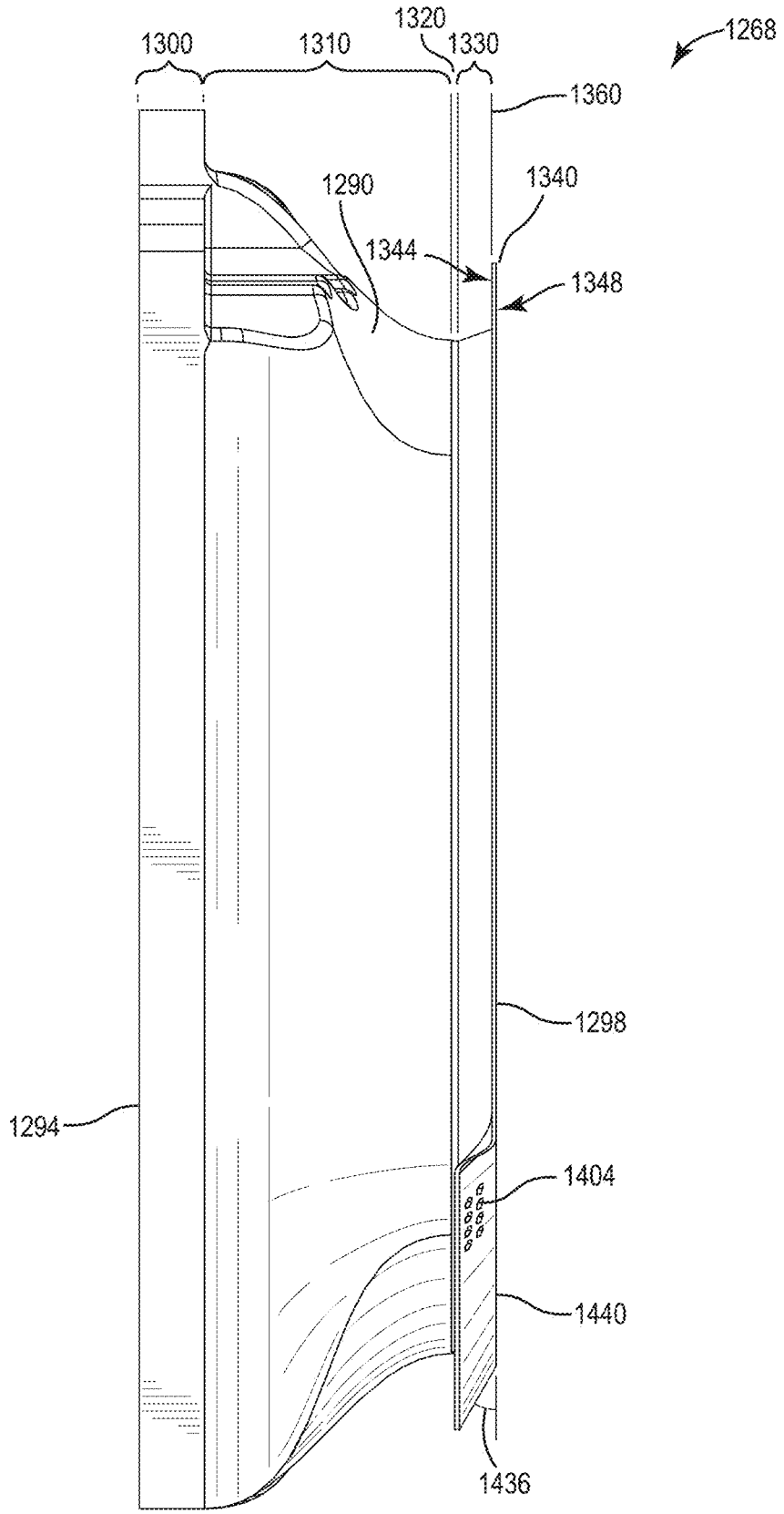
FIG. 23 is a side view of the shroud of FIG. 22.
Figure 24:
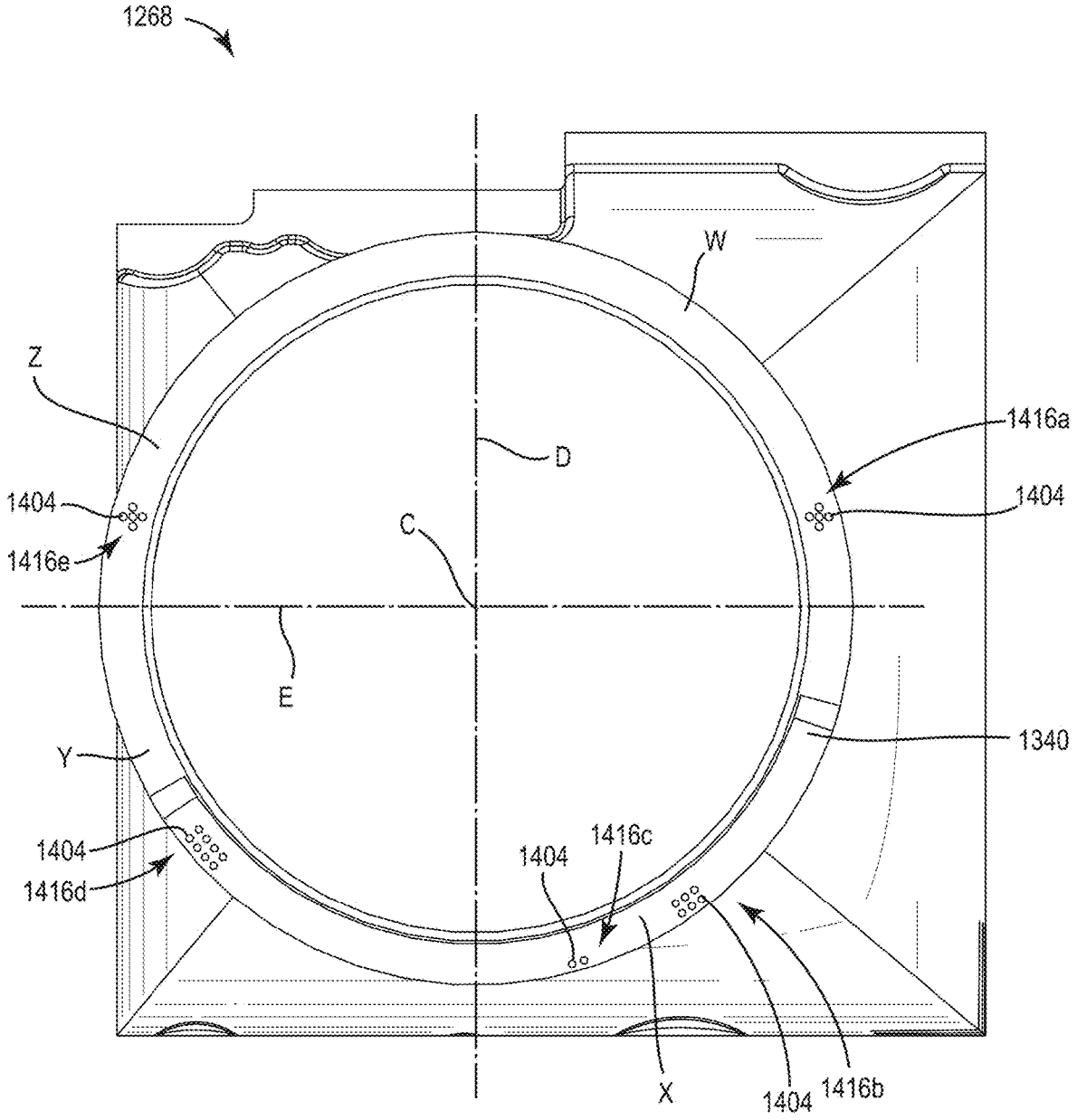
FIG. 24 is a rear view of the shroud of FIG. 22.

FIGS. 22-24 show a shroud 1268 according to another embodiment. The shroud 1268 of FIGS. 22-24 is similar to the shroud 268 of FIGS. 9-10 discussed above, and therefore like structure will be indicated with the same reference numerals plus 1000. Further, the shroud 1268 has the same aperture 1404 and cluster 1016 configuration as the shroud 668 of FIGS. 13-15 except that the fourth cluster 1416*d* has eight apertures 1404 rather than three apertures, and therefore has a double-line configuration rather than a line configuration. That is, the arc length distance between the centers first and fifth clusters 1416*a*, 1416*e* measures substantially 1065 mm, although in additional or alternative embodiments, the arc length may measure between substantially 990 mm and substantially 1280 mm. Moreover, an edge of the second cluster 1416*b* is spaced substantially 225 mm from the first axis D, an edge of the third cluster 1416*c* is spaced substantially 105 mm from the first axis D, and an edge of the fourth cluster 1416*d* is spaced substantially 280 mm from the first axis D. The second and third clusters 1416*b*, 1416*c* are positioned on one side of the first axis D and the fourth cluster 1416*d* is positioned on an opposite side the first axis D. Additionally, in the embodiment of FIGS. 22-24, the lip section 1340 has an angled portion that is oriented at an angle 1436 with respect to the plane 1360 that is coincident with the face 1348 of the lip section 1340. The angled portion facilitates the flow of air towards a bottom of the engine. In the illustrated embodiment, second, third, and fourth clusters 1416*b*, 1416*c*, 1416*d* are positioned on the angled portion of the lip section 1340. In the illustrated embodiment, the angle 1436 is approximately 30 degrees, although in other or additional embodiments the angle 1436 may range from between approximately 15 degrees to approximately 30 degrees.

Moreover, the embodiment of FIGS. 22-24 includes clusters 1416 that are arranged in a "+" shaped configuration (i.e., the first and fifth clusters 1416*a*, 1416*e*), a line configuration (i.e., the third cluster 1416*c*), and a double-line configuration (i.e., the second and fifth cluster 1416*b*, 1416*d*). The apertures 1404 may have other shapes, sizes, and cluster configurations.

The shrouds 268, 468, 668, 868, 1068, 1268 of FIGS. 9-10, 12-15, and 17-24 are discussed in reference to the suction mode of operation shown in FIG. 4. Moreover, the shrouds 268, 468, 668, 868, 1068, 1268 of FIGS. 9-10, 12-15, and 17-24 create more favorable pressure gradients to further increase airflow across heat exchangers of the cooling package 60, resulting in greater heat transfer from cooling circuit fluids and hot under-hood components to the air. Accordingly, the preferred aperture and cluster locations discussed above are dependent on the downstream obstruction location and the escape path of the airflow from the shroud exit. In other words, the main purpose of the additional apertures and clusters discussed herein is to facilitate the movement of flow through and from the respective shroud. As discussed above, the apertures may be circular or hexagonal, although in other embodiments the apertures may be rectangular or triangular.

Various features of the disclosure are set forth in the following claims.

What is claimed is:

1. A shroud for a cooling fan, the fan positionable within the chassis of an off-highway machine, the shroud comprising:

an inlet having a first side, a second side, a third side, and a fourth side;

an outlet; and an elliptical lip section positioned at the outlet, the elliptical lip section including a first planar face and a second planar face facing away from the first planar face, the second planar face having a centroid, wherein a plane coincident with the second planar face includes a first axis parallel to the second and fourth sides of the inlet and a second axis perpendicular to the first axis, both the first axis and the second axis passing through the centroid, wherein the first and second axes together divide the elliptical lip section into four quadrants, wherein a plurality of apertures extend through the elliptical lip section, at least one aperture of the plurality of apertures positioned in each quadrant of the four quadrants of the elliptical lip section, and wherein the plurality of apertures is arranged in aperture clusters.

2. The shroud of claim 1, wherein the apertures are circular.

3. The shroud of claim 1, wherein at least some aperture clusters have a "+" shaped configuration, a staggered configuration, a line configuration, or a double-line configuration.

4. The shroud of claim 1, wherein at least one aperture cluster is positioned in each of the four quadrants of the elliptical lip section.

5. The shroud of claim 1, wherein the aperture clusters include a first aperture cluster oriented approximately between 70 degrees and approximately 90 degrees relative to the first axis, a second aperture cluster oriented between approximately 130 and approximately 175 degrees relative to the first axis, a third aperture cluster oriented between approximately 160 degrees and approximately 190 degrees relative to the first axis, a fourth aperture cluster oriented between approximately 185 degrees and approximately 235 degrees relative to the first axis, and a fifth aperture cluster oriented between approximately 270 degrees and approximately 315 degrees relative to the first axis.

6. The shroud of claim 5, wherein the first aperture cluster and the fifth aperture cluster are positioned on the elliptical lip section symmetrically with respect to the first axis.

7. The shroud of claim 5, wherein the second aperture cluster, the third aperture cluster, and the fourth aperture cluster are positioned on the elliptical lip section asymmetrically with respect to the first axis.

8. The shroud of claim 1, wherein the aperture clusters comprise a first aperture cluster, a second aperture cluster, a third aperture cluster, a fourth aperture cluster, and a fifth aperture cluster, the first aperture cluster being oriented between approximately 40 degrees and approximately 70 degrees relative to the second aperture cluster, the second aperture cluster being oriented between approximately 5 degrees and approximately 35 degrees relative to the aperture third cluster, the third aperture cluster being oriented between approximately 50 degrees and approximately 80 degrees relative to the fourth aperture cluster 816*d*, the fourth aperture cluster being oriented between approximately 40 degrees and approximately 70 degrees relative to the fifth aperture cluster, and the fifth aperture cluster being oriented at between about 140 degrees and approximately 180 degrees relative to the first aperture cluster.

9. A shroud for a cooling fan, the fan being positionable within the chassis of an off-highway machine, the shroud comprising:

an inlet;

an outlet; and an elliptical lip section positioned at the outlet, the elliptical lip section including a first planar face and a second planar face facing away from the first planar face, the second planar face having a centroid, wherein a plane coincident with the second planar face includes a first axis parallel to the second and fourth sides of the inlet and a second axis perpendicular to the first axis, both the first axis and the second axis passing through the centroid, wherein a plurality of apertures extending through the elliptical lip section are configured to at least partially relieve a pressure gradient generated by a portion of the elliptical lip section, and wherein each aperture in the plurality of apertures is arranged in aperture clusters, at least two aperture clusters being spaced at least 30 degrees away from each other.

10. The shroud of claim 9, wherein the first axis and the second axis together define four quadrants of the elliptical lip section, at least one cluster of the plurality of clusters being positioned in each quadrant of the four quadrants.

11. A shroud for a cooling fan, the fan positionable within the chassis of an off-highway machine, the shroud comprising:

an inlet having a first side, a second side, a third side, and a fourth side;

an outlet; and an elliptical lip section positioned at the outlet, the elliptical lip section including a first planar face and a second planar face facing away from the first planar face, the second planar face having a centroid, wherein a plane coincident with the second planar face includes a first axis parallel to the second and fourth sides of the inlet and a second axis perpendicular to the first axis, both the first axis and the second axis passing through the centroid, wherein the first and second axes together divide the elliptical lip section into four quadrants, wherein a plurality of apertures extend through the elliptical lip section, at least one aperture of the plurality of apertures positioned in each quadrant of the four quadrants of the elliptical lip section, and wherein the apertures are circular.

* * * * *